US006398345B1

(12) United States Patent
Sakai et al.

(10) Patent No.: US 6,398,345 B1
(45) Date of Patent: Jun. 4, 2002

(54) IMAGE FORMING METHOD AND AN APPARATUS FOR THE SAME, AND A CLEANING DEVICE

(75) Inventors: Katsuo Sakai, Kanagawa; Takahiko Tokumasu, Tokyo; Kiyoshi Ohshima; Osamu Endo, both of Kanagawa, all of (JP); Per Klockar, Torslanda (SE); Minoru Suzuki, Kanagawa; Kiyotaka Ota, Saitama, both of (JP)

(73) Assignees: Ricoh Co., Ltd., Tokyo (JP); Array Printers AB, Vastra Frolunda (SE)

( * ) Notice: Subject to any disclaimer, the term of this patent is extended or adjusted under 35 U.S.C. 154(b) by 0 days.

(21) Appl. No.: 09/509,127

(22) PCT Filed: Sep. 28, 1998

(86) PCT No.: PCT/JP98/04339

§ 371 (c)(1),
(2), (4) Date: Jun. 7, 2000

(87) PCT Pub. No.: WO99/17168

PCT Pub. Date: Apr. 8, 1999

(30) Foreign Application Priority Data

Sep. 30, 1997 (JP) ..... 9-284728

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 293, 294, 295

(56) References Cited

U.S. PATENT DOCUMENTS

| | | | | |
|---|---|---|---|---|
| 4,198,061 A | | 4/1980 | Dunn | |
| 4,755,837 A | | 7/1988 | Schmidlin et al. | |
| 5,121,144 A | * | 6/1992 | Larson et al. | 346/154 |
| 5,132,712 A | | 7/1992 | Fletcher et al. | |
| 5,200,769 A | | 4/1993 | Takemura et al. | |
| 5,257,046 A | | 10/1993 | Schmidlin | |
| 5,383,973 A | | 1/1995 | Curry, Jr. | |
| 5,477,250 A | | 12/1995 | Larson | |
| 5,526,089 A | | 6/1996 | Larkson et al. | |
| 5,629,726 A | | 5/1997 | Yamasa | |

FOREIGN PATENT DOCUMENTS

| | | |
|---|---|---|
| JP | 58-94481 | 6/1983 |
| JP | 58-96570 | 6/1983 |
| JP | 58-094481 | 6/1983 |
| JP | 58-104769 | 6/1983 |
| JP | 58-104771 | 6/1983 |
| JP | 59-188450 | 10/1984 |
| JP | 63-123060 | 5/1988 |
| JP | 3-168767 | 7/1991 |
| JP | 3-211064 | 9/1991 |
| JP | 4-141458 | 5/1992 |
| JP | 4-191780 | 7/1992 |
| JP | 4-216072 | 8/1992 |
| JP | 4269563 | 9/1992 |
| JP | 4-329154 | 11/1992 |
| JP | 5-92608 | 4/1993 |
| JP | 5-134581 | 5/1993 |
| JP | 5-138919 | 6/1993 |
| JP | 5-286165 | 11/1993 |
| JP | 6-234233 | 8/1994 |
| JP | 7-117257 | 5/1995 |
| JP | 7-273073 | 10/1995 |
| WO | WO 90/14959 | 12/1990 |
| WO | 93/21747 | 10/1993 |

* cited by examiner

*Primary Examiner*—Raquel Yvette Gordon
(74) *Attorney, Agent, or Firm*—McDermott, Will & Emery

(57) ABSTRACT

An air flow is generated in a space adjacent to the toner control member 3, when an image is not being formed, and also a cleaning electric field for moving the toner away from the toner control member 3 is generated in the same space. For instance, a slit 2*a* is formed in an outer peripheral section of a cylindrical and rotatable counter electrode member 2, and an air flow generating source 10 such as a fan is connected to the counter electrode member 2. A convex cleaning electrode 11 is formed around the slit 2*a* of the counter electrode member 2, and a voltage for forming a cleaning electric field is applied from the power supply source for cleaning 8 to this cleaning electrode 11.

29 Claims, 13 Drawing Sheets

IMAGE FORMING METHOD AND AN APPARATUS FOR THE SAME, AND A CLEANING DEVICE

TECHNICAL FIELD

The present invention relates to a cleaning technology For removing a powder deposited on a surface to be cleaned, and More specifically to a cleaning technology for removing, with An image forming method and an apparatus for the same for forming an image on an image forming medium by spraying an electrically charged powder as an image forming substance via a powder control member having powder passage holes thereon towards an image forming medium and selectively making the powder flying towards said recording medium pass through said powder passage holes, powder deposited on a surface of said powder control member.

BACKGROUND ART

There has been known an image forming method and an apparatus for the same in which an image forming method called as direct toning or toner projection is employed.

In this image forming method, a voltage based on the image information is applied to the control electrodes placed in a space around slits or minute passage holes provided in the powder control member, charged powder as toner is selectively passed and moved through said powder passage holes to directly inject the toner to an image forming medium such as paper for forming an image.

In an image forming apparatus in which the image forming system as described is employed, when an operation for forming images is continued, sometimes the powder or some foreign material get deposited on a surface of a portion forming the powder passage holes of the powder control member. When the powder or other foreign material get deposited on a surface of the powder control member, jet of the powder flying towards an image forming medium can not be controlled as intended, which results in degradation of the image quality.

To overcome the problem as described above, there have been known various types of cleaning methods as well as cleaning apparatuses for cleaning the surface of the powder control member. For instance, as a cleaning method making use of a mechanical force, there has been known a method in which cleaning is executed by making a rotating brush contact the powder control unit (refer to Japanese Patent Laid-Open Publication No. HEI 3-211064), a method in which cleaning is executed by shaking the powder control member (refer to, for instance, Japanese Patent Laid-Open Publication No. HEI 4-216072), a method in which the powder control member is thermally expanded by heating, and the powder or other foreign material deposited on the member is removed away by making use of deformation of the powder control member (refer to Japanese Patent Laid-Open Publication No. HEI 4-141458), a method in which cleaning is executed by using an air flow (refer to Japanese Patent Laid-Open Publication No. SHO 58-94481, Japanese Patent Laid-Open Publication No. HEI 4-191780, Japanese Patent Laid-Open Publication No. HEI 4-505899, Japanese Patent Laid-Open Publication No. HEI 5-134581), or the like.

As a method in which cleaning is executed by making use of an electromagnetic force, there has been known a method in which an electric field is applied to the charged powder and cleaning is executed by making use of an electrostatic force (a Coulomb force) (refer to Japanese Patent Laid-Open Publication No. SHO 58-96570, Japanese Patent Laid-Open Publication No. SHO 58-104769, Japanese Patent Laid-Open Publication No. SHO 58-104771, Japanese Patent Laid-Open Publication No. SHO 59-188450, Japanese Patent Laid-Open Publication No. SHO 63-123060, Japanese Patent Laid-Open Publication No. HEI 3-168767, Japanese Patent Laid-Open Publication No. HEI 4-269563, Japanese Patent Laid-Open Publication No. HEI 4-329154, Japanese Patent Laid-Open Publication No. HEI 5-138919).

Also there has been known a method in which the cleaning methods described above are combined. For instance, Japanese Patent Laid-Open Publication No. HEI 5-92608 discloses an image forming apparatus using a magnetic toner as powder and comprising a toner carrier belt as a powder carrier and a rear surface electrode plate provided to hold a control grid as a powder control member via a gap, in which a voltage having a polarity reverse to that of toner is applied to the control grid when an image is not being formed, to promote separation of the deposited toner by an electrostatic force, and also the magnetic toner deposited on a surface of the control grid is removed by rubbing a surface of the control grid with a magnetic brush on the toner carrier belt. Further, for instance, Japanese Patent Laid-Open Publication No. HEI 7-117257 discloses a cleaning method in which toner on a mesh electrode is discharged and removed by simultaneously injecting an air flow and ions to the mesh electrode as a powder control member. Further, for instance, Japanese Patent Laid-Open Publication No. HEI 6-234233 discloses a multi-color image generating apparatus with a toner carrier as a powder carrier and a rear section electrode belt as a counter electrode member provided therein so that the powder control member is held therebetween, in which toner deposited on the powder control member is dropped with a hair-formed pad provided on the rear section electrode belt, and the toner is sucked and recovered through through-holes formed on the rear section electrode belt. Furthermore, for instance, Japanese Patent Laid-Open Publication No. HEI 5-286165 discloses an image forming apparatus with a developing brush roller as a powder carrier and a counter electrode member so that an aperture electrode is held therebetween via a gap, in which toner deposited on the electrode is swung away by vibrating the aperture electrode, and the toner swung away is recovered by an electric field onto the developing brush roller.

It has been turned out, however, that there are various defects in the cleaning methods based on the conventional technology as described above. For instance, in the cleaning method using a brush roller as described above, as the brush roller rotates contacting the powder control member, the powder control member may be damaged, or pulled off brush may get deposited on the developing section or on the powder control member to generate an abnormal image. Also in the cleaning method in which the powder control member is vibrated or the powder control member is thermally deformed to shake off powder, again there is a chance that the powder control member may be damaged, and in addition powder on the powder control member can not be completely removed just by vibrating or deforming the powder control member, and a portion of the powder may remain there in the deposited state. Also the cleaning method using an electromagnetic force can be applied only to a powder which can be magnetized, which is disadvantageous.

As a cleaning method in which an excellent cleaning capability even for non-magnetic powder can be realized without damaging the powder control member, there are the cleaning method using an air flow and the cleaning method using an electrostatic force (a Coulomb force).

However, in the cleaning method using an air flow described above, for completely removing the powder deposited on the powder control member, it is necessary to provide a large-sized fan, a large-sized pump or the like, as a source for generating an air flow, which not only causes an increase in the cost but also generates larger noise due to the fan or the like. In a case of the cleaning method in which an air flow and ions are simultaneously blown to a mesh electrode as a powder control member as disclosed in Japanese Patent Laid-Open Publication No. HEI 7-117257, as toner on the mesh electrode is removed being discharged, it can be considered that the excellent cleaning performance can be obtained even if an air flow is set to a weak level, but a corona-generating apparatus for generating ions is required, and the simplicity, which is one of the advantages features of the direct toning method, is lost.

When it is tried to completely clean off the powder deposited on a powder control member with the cleaning method that makes use of an electrostatic force (a Coulomb force), it is necessary to apply a high voltage for forming a cleaning electric field for effecting the electrostatic force to the powder, but if the voltage is made excessively higher, discharging may be generated. When magnetic toner, which can be magnetized from outside, is removed by promoting separation of the magnetic toner on a control grid as a powder control member with an electrostatic force and rubbing the toner with a magnetic brush as disclosed in Japanese Patent Laid-Open Publication No. HEI 5-92608 described above, an amplitude of the electric field for effecting the electrostatic force can be suppressed to a degree where discharging is not generated, but there is a disadvantage that this cleaning method can be applied only to magnetic toner (powder). Also in a case where toner shaken off by vibrating an aperture electrode as a powder control member is recovered with an electric field onto a developing brush roller, there is the possibility to suppress the amplitude of the electric field to a level at which discharging is not generated, but in this case toner (powder) may not be shaken off by means of vibration and may remain there.

In an image forming apparatus comprising a plurality of image forming sections for selectively allowing passage of powder flying towards an image forming medium through powder passage holes of the powder control member for forming a multi-color image or for other purposes, when the powder control member is to be cleaned, the possibility can be considered that a cleaning device is provided for each powder control member, but then a plurality of cleaning devices for the powder control members are required, which results in a disadvantage that the number of parts increase. There has been known a method in which a hair-formed pad as a cleaning member is provided on a rear section electrode belt as a counter electrode member for cleaning the plurality of powder control member and toner deposited on the powder control member is dropped with this hair-formed pad (refer to Japanese Patent Laid-Open Publication No. HEI 6-234233), but the powder control member may be damaged due to rubbing by the hair-formed pad.

DISCLOSURE OF THE INVENTION

It is a first object of the present invention to provide an image forming method for forming an image on an image forming medium by spraying an electrically charged powder as an image forming substance via a powder control member having holes thereon through which the powder can pass towards an image forming medium and selectively allowing passage of the powder flying towards said image forming medium through the. holes according to the image information, in which excellent cleaning capability can be achieved, by combining an air flow with an electrostatic force generated by an electric field, even to non-magnetic powder deposited on a powder control member with a small-sized air flow generating unit as well as with an applied voltage at a level where discharging is not generated, and an apparatus for the same.

It is a second object of the present invention to obtain a cleaning device adapted to the image forming method and apparatus in which excellent cleaning performance can be realized even to non-magnetic powder deposited on a body to be cleaned with a small-sized air flow generating unit as well as keeping the applied voltage at a level where discharging is not generated by combining an air flow with an electrostatic force generated by an electric field.

It is a third object of the present invention to provide an image forming apparatus comprising a plurality units of image forming sections each for forming an image on an image forming medium by controlling a powder as an image forming substance flying towards the recording medium with a powder control member having powder passage holes and control electrodes provided around the powder passage holes, which can realize the excellent cleaning capability for each powder control member, even when using a cleaning device making it possible to clean a powder control member in a non-contact form without giving any damage to the powder control member, with a smaller number of components as compared to the configuration in which a plurality of cleaning devices are provided to powder control members respectively.

It is a fourth object of the present invention to provide an image forming apparatus comprising a plurality units of image forming sections each for forming an image on an image forming medium transferred by a belt member by controlling jet of powder as an image forming substance flying from a powder carrier to a counter electrode member, which can easily clean each powder control member without independently providing a cleaning device dedicated to non-contact cleaning of a powder control member, there by not causing any damage due to rubbing.

To achieve the first object described above, the present invention provides an image forming method for forming an image on an image forming medium by making an electrically charged powder as an image forming substance jet via a powder control member having holes thereof through which the powder can pass towards an image forming medium and selectively allowing passage of the powder flying towards the recording medium through the holes according to the image information; wherein an air flow is generated in a space adjacent to the powder control member and at the same time generating a cleaning electric field in said space for making the powder move away from the powder control member.

In the image forming method according to the above invention, an air flow is generated in a space adjacent to the powder control member, and cleaning is executed by blowing away the powder deposited on the surface of the powder control member. Simultaneously with the cleaning with an air flow, a cleaning electric field for moving the powder away from the powder control member by an electrostatic force, and powder deposited on the surface of the powder control member is separated away from the surface. As described above, by combining an air flow with an electrostatic force, cleaning with an air flow and cleaning with an electrostatic force are executed simultaneously.

To achieve the first object described above, the present invention provides an image forming apparatus for forming an image on an image forming medium by making an electrically charged powder as an image forming substance jet via a powder control member having holes thereon through which the powder can pass towards the image forming medium and selectively allowing passage of the powder flying towards the image forming medium through the holes according to image information; and the image forming apparatus comprises an air flow generating unit for generating an air flow in a space adjacent to said powder control member; a cleaning electric field forming unit for forming a cleaning electric field making the powder move away from the powder control member in the space; and a control unit for controlling generation of an air flow by the air flow generating unit as well as formation of the cleaning electric field by the cleaning electric field forming unit.

In the image forming apparatus according to the above invention, when no image is being formed and an image on an image forming medium is not affected, an air flow is generated in a space adjacent to a powder control member by controlling an air generating unit with a control unit, and powder deposited on the surface of the powder control member is separated from the surface for cleaning. Simultaneously, when cleaning with an air flow, a cleaning electric field for moving powder away from the powder control member with an electrostatic force is generated by controlling the electric field control unit with the control unit, and the powder deposited on the surface of the powder control member is separated from the surface by the cleaning electric field for cleaning. As described above, by combining an air flow with an electrostatic force, cleaning with an air flow and cleaning with an electrostatic force are executed simultaneously.

With the image forming apparatus according to the present invention, the air flow generating unit comprises a counter member for an air flow having an air flow port for sucking or blowing out an air flow to and from said powder control member, and a driving unit for driving said counter member for an air flow so that said air flow port can be positioned at an opposite position close to and facing said powder control member and at an off position away from said powder control member.

In the image forming apparatus according to the above invention, the counter member for an air flow having an air flow port for sucking or blowing out an air flow provided at a position separated away from the powder control member is driven by the driving unit when an image is not being formed; and the air flow port is moved to a position close and opposing to the powder control member. With this movement of the air flow to the opposing position, powder deposited on a surface of the powder control member is removed and cleaned off with an air flow sucked into and blown out from the air flow.

The image forming apparatus according to the present invention comprising a powder carrier for carrying thereon an electrically charged powder as an image forming substance; a counter electrode member arranged at a position opposing to the powder carrier; a jet electric field forming unit for forming a jet electric field making the powder on the powder carrier jet towards the counter electrode member; a powder control member having powder passage holes for controlling jet of the powder from the powder carrier to the counter electrode member between the powder carrier and the outer electrode member and also having a control electrode in a space around each of the powder passage holes; and a power source for applying a voltage to the control electrode according to the image information, and the cleaning electric field forming unit comprises a cleaning electrode provided around the air flow port of the counter member for an air flow and a power source for applying a voltage for forming the cleaning electric field between a cleaning electrode and the control electrode.

In the image forming apparatus according to the above invention, when an image is formed, the electrically charged powder as an image forming substance is flown from the powder carrier to the counter electrode member due to the jet electric field formed by the electric field forming unit. The jet of powder to this counter electrode member is controlled by the powder control member having a control electrode with a voltage applied thereto through the powder passage hole according to image information, and an image is formed on the recording medium by selectively depositing the powder on the recording medium carried to a section between the counter electrode member and the powder control member.

And, when an image is not being formed, by applying a voltage to the cleaning electrode provided around the air flow ports of the counter member for an air flow from a power supply source for cleaning, a cleaning electric field is formed between the cleaning electrode and the control electrode of the powder control member. With this cleaning electric field, the powder deposited on the surface of the powder control member is separated from the surface and is moved towards the air flow or away from the air flow. In association with movement of the powder to or away from a surface of the powder control member, the powder deposited on a surface of the powder control member is removed and cleaned off with an air sucked from or blown out from the air flow.

With the image forming apparatus according to the present invention, the counter electrode member comprises a rotatable cylindrical member with the flow port formed thereon or a belt member and is also used as the counter member for air flow.

In the image forming apparatus according to the above invention, when an image is formed, the air flow port of the counter electrode member formed with a cylindrical member rotatable against the powder control member carrier or a belt member is positioned at a position opposing to a section with no air flow port formed therein, and an electrically charged powder as an image forming substance is flown from the powder carrier to the counter electrode member. The jet of powder towards this counter electrode member is controlled by the powder control member having powder passage holes and a control electrode with a voltage applied thereto according to image information, and an image is formed on the recording medium by selectively depositing the powder on the recording medium carried to a section between the counter electrode member and the powder control member.

When an image is not being formed, the counter electrode member is rotated so that the air flow port formed on the counter electrode member also functioning as the counter member for air flow faces a surface of the powder control member, and the powder deposited on the surface of the powder control member is removed and cleaned off with an air flow sucked through or blown out from the air flow port.

With the image forming apparatus according to the present invention, the cleaning electric field is mainly formed by a voltage applied to the cleaning electrode.

In the image forming apparatus according to the above invention, the cleaning electric field between the cleaning electrode around the air flow port of the counter member for an air flow and the control electrode of the powder control member is formed mainly by a voltage applied to the cleaning electrode, so that an electric potential in the control electrode can be suppressed to a level equal to or below a voltage level durable for components of the electric circuit such as an IC connected to the control electrode.

With the image forming apparatus according to the present invention, the cleaning electric field is an electric field formed by superimposing an alternating electric field to a static electric field.

In the image forming apparatus according to the above invention, a cleaning electric field is formed by superimposing an alternating electric field to a static electric field in a space adjacent to the powder control member, and the powder can easily be separated from the surface of the powder control member by effecting a force causing reciprocal movement of the powder deposited on the powder control member as compared to a case where a cleaning electric field comprising only an static electric field is formed.

With the image forming apparatus according to the present invention, a frequency of the alternating electric field is set to a range higher than 0.5 kHz or lower than 3 kHz.

In the image forming apparatus according to the above invention, a force causing reciprocal movement of powder deposited on the powder control member can be effected more accurately by setting a frequency of an alternating electric field in the cleaning electric field within the specified range as described above.

With image forming apparatus according to the present invention, orientation of the air flow and that of the cleaning electric field are set so that orientation of movement of powder moved by said air flow and that of powder moved by said cleaning electric field are identical.

In the image forming apparatus according to the above invention, movement of the powder moved by the air flow is made identical to that of the powder moved by the cleaning electric field, and the powder moved by the cleaning electric field away from the powder control member is moved by the air flow in the substantially same direction of the air flow.

With the image forming apparatus according to the present invention, a maximum value of the cleaning electric field is set to a value smaller than a discharge start electric field obtained according to a Paschen's electric discharge curve.

In the image forming apparatus according to the above invention, a maximum value of the cleaning electric field is set to a value smaller than a discharge start electric field obtained according to a Paschen's electric discharge curve to prevent generation of the cleaning electric field.

With the image forming apparatus according to the present invention, an air pressure difference between an air pressure within the counter member for air flow for sucking or blowing out an air flow to and from the powder control member and the atmospheric pressure is set to less than 15 mm ($H_2O$).

In the image forming apparatus according to the above invention, air pressure different between the air pressure inside the counter member for air flow and atmospheric pressure is set to 15 mm ($H_2O$) or below, so that a low cost fan or the like generating little noises can be used as the air generating unit.

With the image forming apparatus according to the present invention, formation of the cleaning electric field by the cleaning electric field forming unit is started in the state where an air flow has been generated by the air flow generating unit.

In the image forming apparatus according to the above invention, in the state where the air flow has been generated by the air flow generating unit and cleaning of the powder with the air flow is being executed, formation of a cleaning electric field by said cleaning electric field generating unit is started and cleaning by the electric field is added, so that, different from a case where cleaning with the electric field is started in the state where cleaning of powder with an air flow is not executed, because of this, powder is not deposited on a surface of a member constituting the cleaning electric field forming unit such as a counter member for an air flow (counter electrode member).

With the image forming apparatus according to the present invention, a gap between the counter member for air flow when the air flow port is present at the opposite position and the powder control member is set to a value smaller than that when the air flow port is present at the off position.

In the image forming apparatus according to the above invention, a gap between the counter member for an air flow when the air flow port is present at the opposite position and the powder control member is set to a small value, so that cleaning with an air flow can be executed more efficiently as compared to a case where the gap be set to the same value as that when the air flow port is at the off position.

With the image forming apparatus according to the present invention, a gap between the counter member for air flow when the air flow port is at the opposite position and the powder control member is set to less than 0.3 mm.

In the image forming apparatus according to the above invention, by setting the gap to 0.3 mm or less, a smaller air flow generating unit such as a fan or the like for generating a specified air flow provided in a space adjacent to the powder control member can be used, and at the same time a level of a voltage for forming a cleaning electric field in the space can be suppressed to a safe level.

In order to achieve the second object described above, the cleaning device according to the present invention comprises an air flow generating unit for generating an air flow in a space adjacent to a cleaned body; and a cleaning electric field forming unit for forming a cleaning electric field moving the powder off from the cleaned body in the space.

In the cleaning device according to the above invention, an air flow is generated in a space adjacent to a surface to be cleaned, and powder deposited on the surface to be cleaned is separated from the surface for cleaning. Simultaneously with the cleaning with an air flow, a cleaning electric field for moving the powder away from the cleaned surface with an electrostatic force is formed, and the powder deposited on the surface is separated from the surface. As described above, by combining an air flow with an electrostatic force, cleaning with an air flow and that with an electrostatic force are executed simultaneously.

It should be noted that, in the cleaning device according to the above invention, to obtain more excellent cleaning capability, it is preferable to form the cleaning electric field with a voltage in which a DC voltage is superimposed to an AC voltage or to set the frequency of the AC voltage within a range in which excellent cleaning capability can be obtained. Also to more securely prevent the generation of electric discharge due to the cleaning electric field, it is desirable to set a gap between a pair of electrodes with the cleaning electric field generated therebetween, a voltage difference between the electrodes, an air pressure in a space with the cleaning electric field formed therein, or other parameters to a level where electric discharge is not generated according to a Paschen's curve. Further, to improve the cleaning efficiency more, it is preferable to make orientation of movement of the powder moved with the air flow substantially equal to that of the powder moved by the cleaning electric field.

To achieve the third object described above, the image forming apparatus according to the present invention comprises a plurality of image forming section each forming an image on an image forming medium by making an electrically charged powder as an image forming substance jet via a powder control member having powder passage holes towards the recording medium and selectively allowing passage of said powder flying towards said recording medium through the powder passage hole according to image information, and also having a belt member which can move along image forming positions on the image forming section and a belt driving unit for driving said belt member, and in the image forming apparatus, a cleaning device for cleaning the powder control member is movably provided between a cleaning position opposing to the powder control member and an escaping position off from the image forming position. It should be noted that herein the belt member includes not only a belt member for carrying an image forming medium but also a belt member for temporally carrying an image comprising the powder before transferred to the recording medium as an intermediate image carrier.

In the image forming apparatus according to the above invention, an image can be formed by each image forming section on an image forming medium by moving, when an image is to be formed, the cleaning device for cleaning each powder control member is moved from an image forming position for each image forming section to an escaping position off from the image forming position. And when an image is not being formed, the cleaning device is successively moved to a cleaning position opposing to each powder control member to clean the respective powder control member.

With the image forming apparatus according to the present invention, the cleaning device can move along the belt member and also there is provided a driving unit for moving the cleaning device between the escaping position and the cleaning position.

In the image forming apparatus according to the above invention, when an image is formed, the cleaning device for cleaning the powder control member is driven by the driving unit along the belt member to move the cleaning device from the image forming position to the escaping position off from the image forming position to form an image by each image forming section onto a recording medium. When an image is not being formed, the cleaning device is successively moved by the driving unit along the belt member to a cleaning position opposing to each powder control member to clean each powder control member.

With the image forming apparatus according to the present invention, the cleaning apparatus can be set in the slave state where the cleaning device follows movement of the belt member as well as in the released state where the slave state has been released and, also there is provided a slave state switching unit for switching the cleaning device between the slave state and the released state.

In the image forming apparatus according to the above invention, when an image is not being formed and the cleaning device is moved, a state of the cleaning device is switched by the slave state switching unit to the slave state where the cleaning device follows movement of the belt member, and the cleaning device is successively moved, by diving the belt member, to a cleaning position of the powder control member for each image forming section. When an image is being formed and the cleaning device has been moved to the escaping position, a state of the cleaning device is switched by the slave state switching unit to the slave state released state where the slave state to the belt member has been released, so that the cleaning device does not move from the escaping position irrespective of whether the belt member is driven for forming an image on the recording medium or not.

With the image forming apparatus according to the present invention, the cleaning device comprises a belt turning unit for spanning the belt member over a plurality of rotary bodies and turning a portion of the belt member in a direction reverse to the direction in which the belt member opposes to the powder control member, and a cleaning member arranged in an area around which the belt member turns.

In the image forming apparatus according to the above invention, the cleaning member arranged in the area around which the belt member turns can successively be moved to a cleaning position opposing to a powder control member in each image forming section.

With the image forming apparatus according to the present invention, the rotary bodies for the belt turning unit is also used as the cleaning member.

In the image forming apparatus according to the above invention, the rotary bodies for the belt turning unit is also used as the cleaning member, so that a number of the components is further reduced.

With the image forming apparatus according to the present invention, each of the image forming sections comprises a powder carrier for carrying thereon an electrically charged powder as an image forming substance, a counter electrode member arranged at a position opposing to said powder carrier, a jet electric field forming unit for forming a jet electric field making the powder on the powder carrier jet towards the counter electrode member, a powder control member having powder passage holes for controlling jet of the powder from the powder carrier to the counter electrode member between the powder carrier and the counter electrode member and also having a control electrode in a space around each of the powder passage hole, and the image forming apparatus also having a power source for applying a voltage to the control electrode according to image information, and there is provided in the image forming apparatus, an escaping unit for moving the counter electrode member to an escaping position off from a moving path of said cleaning device.

In the image forming apparatus according to the above invention, when an image is not being formed, the counter electrode member located by the escaping unit at a position opposing to each image forming section is moved from the path through which the cleaning device moves off to the escaping position, so that the cleaning device can be moved more surely to the cleaning position in each image forming section without causing any interference between the cleaning device and the counter electrode member.

With the image forming apparatus according to the present invention with each of the image forming sections comprising a powder carrier for carrying thereon an electrically charged powder as an image forming substance, a counter electrode member arranged at a position opposing to said powder carrier, a jet electric field forming unit for forming a jet electric field making the powder on the powder carrier jet towards the counter electrode member, a powder control member having powder passage holes for controlling jet of the powder from the powder carrier to the counter electrode member between the powder carrier and the counter electrode member and also having a control electrode in a space around each of said powder passage hole, the image forming apparatus also having a power source for applying a voltage to said control electrode according to image formation, the belt unit is formed with a conductive material and is used as a common counter electrode member opposing to each powder carrier.

In the image forming apparatus according to the above invention, when an image is formed, powder on each powder carrier is flown towards the belt member as a common counter electrode member formed with a conductive material.

With the image forming apparatus according to the present invention, a belt unit formed so that the belt member is included therein is provided so that the belt unit can swing around a swinging shaft provided in the side contrary to the escaping position with a cleaning position for the each powder control member therebetween.

In the image forming apparatus according to the above invention, the belt unit formed so that the belt member is included therein is swung around the swinging shaft provided in the side contrary to the escaping position with the cleaning position for the each powder control member provided therebetween, so that the cleaning device for cleaning each powder control member can be moved to the cleaning position without contacting the belt member.

With the image forming apparatus according to the present invention with each of the image forming sections comprising a powder carrier for carrying thereon an electrically charged powder as an image forming substance, a counter electrode member arranged at a position opposing to said powder carrier, a jet electric field forming unit for forming a jet electric field making the powder on the powder carrier jet towards said counter electrode member, a powder control member having powder passage holes for controlling jet of the powder from the powder carrier to the counter electrode member between the powder carrier and the counter electrode member and also having a control electrode in a space around each of said powder passage holes, the image forming apparatus also having a power source for applying a voltage to the control electrode according to image information, the counter electrode member is provided so that it can swing together with the belt unit.

In the image forming apparatus according to the above invention having a counter electrode member provided at a position opposing to a powder carrier, the counter electrode member can be slid together with the belt unit, so that it is possible to secure a path for moving the cleaning device for cleaning each powder control member to the cleaning position without giving any interference to the belt member not to the counter electrode member.

To achieve the fourth object as described above, the image forming apparatus according to the present invention comprising a plurality of image forming sections each comprising a powder carrier for carrying thereon an electrically charged powder as an image forming substance, a counter electrode member arranged at a position opposing to said powder carrier, a jet electric field forming unit for forming a jet electric field making powder on the powder carrier jet towards said counter electrode member, a powder control member having powder passage holes for controlling jet of the powder from the powder carrier to the counter electrode member between the powder carrier and the counter electrode member and also having a control electrode in a space around each of said powder passage holes, the image forming apparatus also having a belt member which can move along the image forming positions in each image forming section, a belt driving unit for driving said belt member, and a power source for applying a voltage to the control electrode according to image information, and in the image forming apparatus, an opening for cleaning is formed in the belt member and the counter electrode member is also used as a cleaning member for cleaning said powder control member via said opening.

In the image forming apparatus according to the above invention, the opening for cleaning formed on the belt member is located at a position opposing to the powder control member, and the powder control member is cleaned via the opening with the counter electrode member used also as a cleaning member.

With the image forming apparatus according to the present invention, a rotary member with a distance from a portion of its periphery used for the cleaning to a center of rotation is longer than a distance from the periphery of the other portion to the center of rotation is used as the counter electrode member, and there is provided a rotating/driving unit for driving the rotary member.

In the image forming apparatus according to the present invention, when an image is not being formed, the powder control member can easily be cleaned by rotating the counter electrode member also used as a cleaning member to locate the outer peripheral surface with a longer distance from a center of rotation of the counter electrode member at a position opposing to the powder control member. And, when an image is formed, interference to the belt member is prevented by rotating the outer peripheral surface with a shorter distance from a center of rotation of the counter electrode member to face the peripheral surface to the powder control member.

With the image forming apparatus according to the present invention, edge of said belt member is reinforced with a reinforcing material.

In the image forming apparatus according to the above invention, edge of the belt member with the opening for cleaning formed thereon is reinforced with a reinforcing material to improve the durability of the belt member.

With the image forming apparatus according to the present invention, edge of the opening of the belt member is reinforced with a reinforcing material.

In the image forming apparatus according to the above invention, edge of the opening of the belt member is reinforced with a reinforcing material to improve durability of the belt member.

With the image forming apparatus according to the present invention, a device for generating an air flow in a space adjacent to the powder control member and also forming a cleaning electric field for moving the powder away from the powder control member when located at a position opposing to the powder control member is used.

In the image forming apparatus according to the above invention, when an image is not being formed and the image on the image forming medium is not affected, the cleaning device is successively located to a position opposing to each powder control member, an air flow is generated in a space adjacent to the powder control section, and the powder deposited on a surface of the powder control member is separated and cleaned off from the surface. Simultaneously with the cleaning with an air flow, a cleaning electric field for moving the powder with an electrostatic force away from the powder control member is formed, and the powder deposited on a surface of the powder control member is separated and cleaned off from the surface. Thus by combining an air flow with an electrostatic force, cleaning with an air flow and that with an electrostatic force are executed simultaneously.

BRIEF DESCRIPTION OF DRAWINGS

The present invention will be further understood from the following description with reference to the accompanying drawings, in which:

FIG. 7(*b*) is an explanatory view showing a state of the counter electrode member during the cleaning operation;

FIG. 12(*b*) is an explanatory view showing a state of the counter electrode member during the cleaning operation;

DETAILED DESCRIPTION

In the next, description is made for embodiments of the present invention with reference to the related drawings.

EMBODIMENT 1

Figure 1:
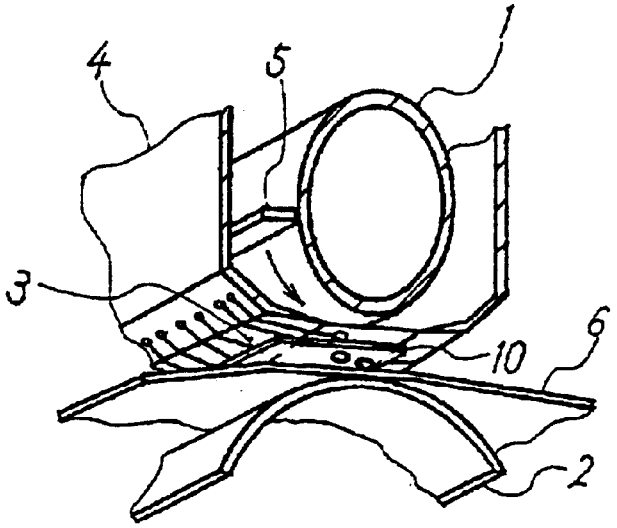
FIG. 1 is a perspective view showing general configuration of an image forming apparatus according to one embodiment of the present invention.

FIG. 1 is a perspective view showing general configuration of the key sections of an image forming apparatus according to Embodiment 1 of the present invention. This image forming apparatus uses toner as an electrically charged powder as an image forming substance, and comprises a sleeve-formed toner carrier as a powder carrier 1, a sleeve-formed counter electrode member 2 provided at a position opposing the toner carrier 1, and a toner control member 3 as a powder control member. The toner carrier 1 is located in a toner vessel 4 for accommodating toner therein, and toner can be carried on a surface of the toner carrier 1 with the known technology employed when toner is carried on a developing roller in an image forming apparatus based on the known electrophotography system. In this embodiment, toner charged with minus polarity due to friction between a doctor blade 5 or a toner supply member not shown herein and the toner carrier 1 is carried on the toner carrier 1 because of an electrostatic force and restricted by the doctor blade 5 to form a toner layer.

Figure 2:
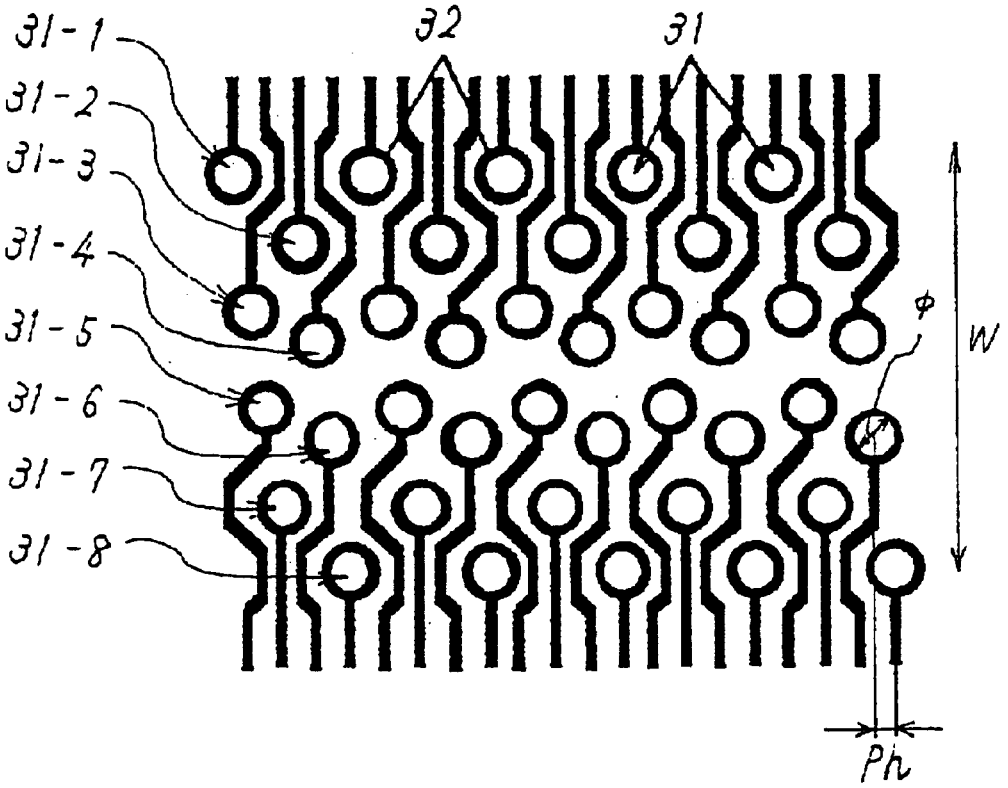
FIG. 2 is an explanatory view showing a pattern of a control electrode in a toner control member in the image forming apparatus.

The toner control member 3 is attached to a toner vessel 4 in such a way that the toner control member 3 shields an opening formed in a lower wall section thereof. This toner control member 3 has, as shown in FIG. 2, toner passage holes (described as "holes" hereinafter) as a plurality of powder passage holes and a ring-formed control electrode 32 formed around each of the holes to control jet of toner, between the toner carrier 1 and counter electrode member 2, from the toner carrier 1 to the counter electrode member. Such parameters as a diameter $\phi h$ of this hole 31 or a pitch Ph between the holes 31 in a direction perpendicular to a carrying direction of recording paper 6 as an image forming medium (the axial direction of the toner carrier 1) are set according to a resolution of an image formed on the recording paper 6. In this embodiment, to enable formation of an image with a resolution of around 300 dpi, the holes 31 each having a diameter $\phi h$ of 0.160 mm are formed with the pitch Ph of 0.0845 mm on a base board with a thickness of 0.075 mm and made from polyimide. Furthermore, the holes 31 are formed in 8 rows (31-1 to 31-8) in an area with a width W in the carrying direction of the recording paper 6 of around 2 mm, and a total number of the holes 31 is 2,300. A ring-formed control electrode 32, which is electrically independent from other holes, is formed around each of the holes 31, and each of the control electrodes 32 is connected to a power circuit for applying a voltage according to image information.

Figure 3:
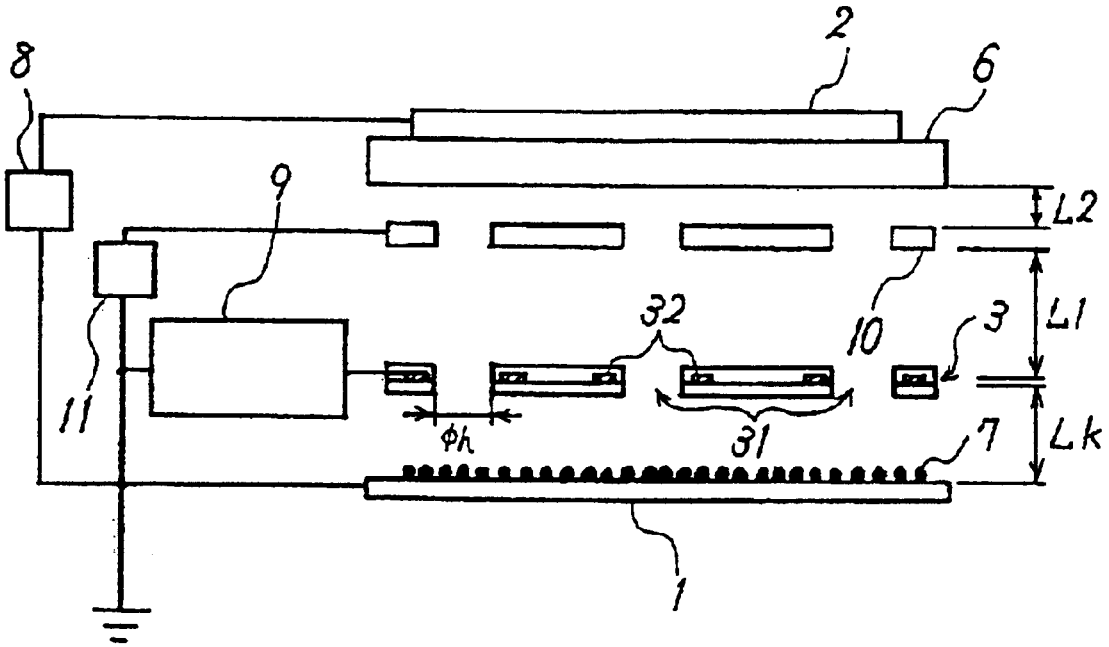
FIG. 3 is an enlarged simulated view showing an image forming section in the image forming apparatus.

FIG. 3 is an enlarged simulated view showing an image forming section in which the toner carrier 1 is opposing to the counter electrode member 2 with the toner control member therebetween. The toner carrier 1 is grounded, and a power supply source 8 as a jet electric field forming unit for forming a jet electric field to fly the toner 7 carried on the toner carrier 1 towards the counter electrode member 2 is connected to a section between this toner carrier 1 and the counter electrode member 2. With this power supply unit 8, a voltage with polarity reverse to the average charging polarity of the toner 7, namely a positive DC voltage is applied to the counter electrode member 2.

Also a power supply source 9 for applying a control voltage generated according to image information (described as "image voltage supply source" hereinafter) to each control electrode 32 is connected to a section between the toner carrier 1 and each control electrode 32 of the toner control member 3. With this image voltage supply source 9, an image signal voltage, which is independent respectively, is applied to each of the control electrodes 32.

Herein a gap Li between the control electrode 32 of the toner control member 3 and the counter electrode member 2 is set to 0.4 mm, a gap Lk between the control electrode 32 and the toner carrier 1 is set to 0.05 mm, a rotating speed of the toner carrier 1 is set to 150 mm/sec and a carriage speed of the recording paper 6 is set to 50 mm/sec, respectively.

Figure 4:
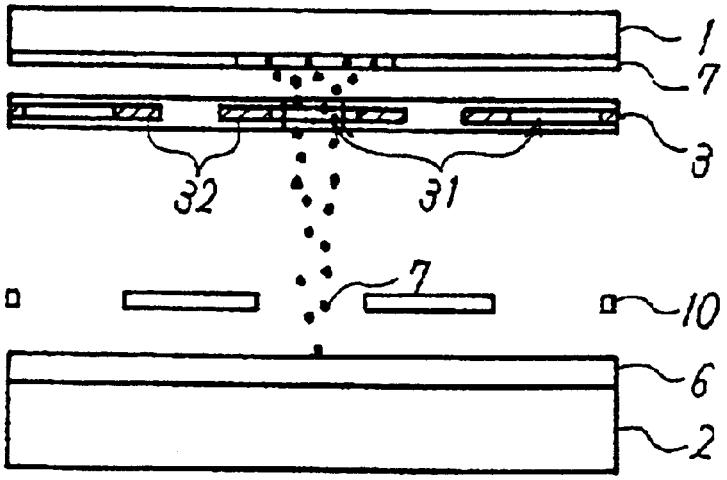
FIG. 4 is a simulated view showing jet of toner in the image forming apparatus.

FIG. 4 is a simulated view showing a jet state of toner. For instance, when the toner carrier 1 is grounded with a high DC voltage of +1.2 k V applied to the counter electrode member 2 and +325 V applied to a control voltage 32 for 0.4 msec, an electric field of $4\times10^6$ V/m is applied to the toner 7 on the toner carrier 1. As a result of effect by the electric field, a Coulomb force applied to the toner 7 becomes larger than a sum of adhesive forces or image forces effecting between the toner 7 and the toner carrier 1, the toner 7 starts flying towards the counter electrode member 2, passes through the holes 31 in the toner control member 3, continues to fly being attracted by a jet electric field formed with a voltage applied to the counter electrode member 2, and hits the recording paper 6 being carried on the counter electrode member 2 to stop there, thus an image is formed on the recording paper 6.

As described above, it is possible to form an image on the recording paper 6 with an image forming apparatus with the configuration as described above, but if the image forming operation is repeatedly executed, the toner is deposited on a surface of the toner control member 3, especially on a surface close to the control electrode 32, which may make it impossible to control indented jet of the toner.

Figure 5:
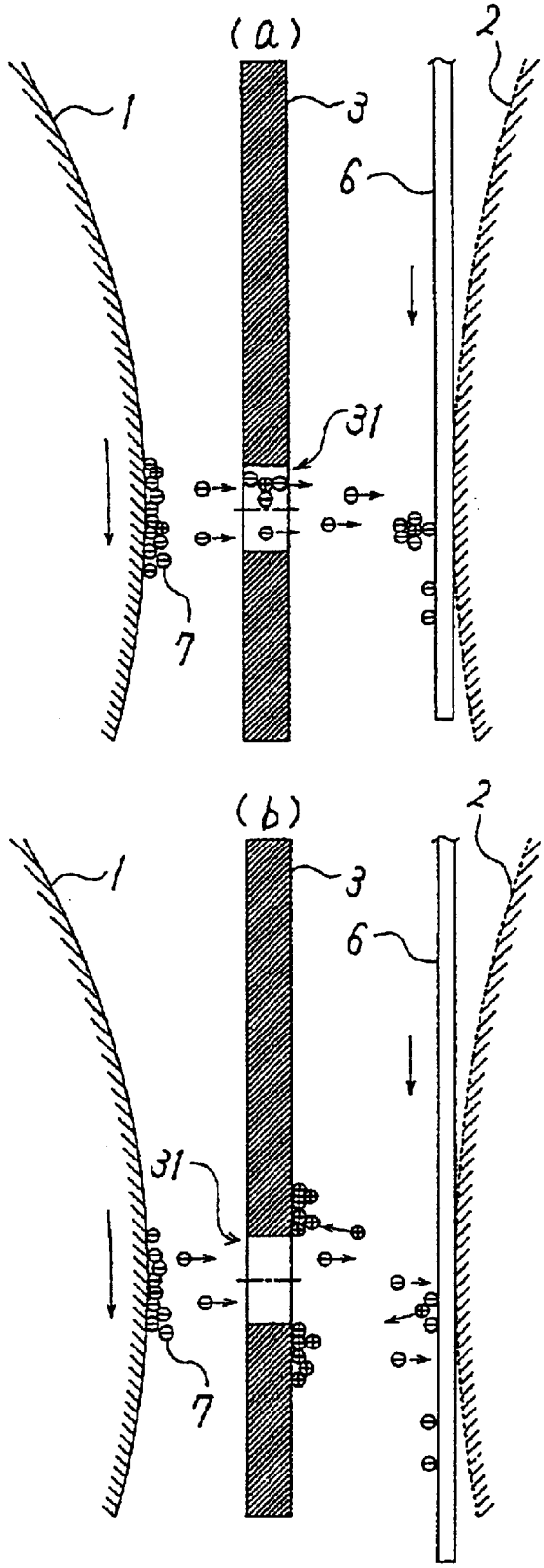
FIGS. 5(*a*) and 5(*b*) are explanatory views each showing deposition of toner on the toner control member in the image forming section.

FIG. 5(*a*) and FIG. 5(*b*) are explanatory views each for illustrating how toner is deposited on a surface of the counter electrode member 2 in the toner control member 3. Observation of jet of the toner 7 with a high speed camera shows not only that the toner 7 is flying particle by particle, but also that several particles form a block when flying (this block of toner particles are described as "cluster" hereinafter). A portion of the toner 7 forming this cluster is charged not to the regular polarity as shown in FIG. 5(*a*) (a negative polarity in this embodiment), but to a reverse polarity (a positive polarity in this embodiment) (The toner charged to a polarity reverse to the regular polarity is described "Wrong Sign Toner", or "WST" in abbreviation). This WST flies against an electric field, because an adhesion force working with toner charged to the peripheral regular polarity (negatively charged toner) is stronger than the electrostatic force generated because of the effect of the WST to the electric field.

As shown in FIG. 5(*b*), when a cluster hits the recording paper 6, WST 7' is released from restriction by the regularly-charged toner 7 (negatively charged toner) because of the impact and flies in the reverse direction because of an electrostatic force generated by an electric field and is deposited on a surface close to the control electrode 32 around the holes 31 of the toner control member 3. This is the mechanism of deposition of toner (WST) 7' charged to a polarity reverse to the regular polarity on a surface of the toner control member 3 in the side of the recording paper 6. As a result of experiments conducted by the present inventor and other persons, it has been turned out that the total quantity of deposited toner is 3 to 5% of a total quantity of toner, and that, in a case where an image is formed on a sheet of A4 size paper with the image area of 20%, the quantity is in a range from around 6 to 10 mg. Also it has been turned out that, in a case an operation for forming images on the recording paper 6 is continued without cleaning the toner deposited on a surface of the toner control member, the holes 31 of the toner control member 3 are clogged when the image has been formed on less than 10 sheets of recording paper and a portion of the image is lacked. The quantity of toner deposited at this point of time is in a range from around 15 to 30 mg. From this result, it is clear that toner deposited on a surface of the toner control member 3 must be cleaned off each time an image is formed on one sheet of recording paper or a specified number of sheets of recording paper.

For the reason described above, there is provided a cleaning device for cleaning toner deposited on a surface of the toner control member 3 as a surface to be cleaned. With this cleaning device, different from the cleaning method based on the conventional technology, cleaning is executed by effecting an air flow and an electrostatic force to toner deposited on a surface of the toner control member. To realize the cleaning as described above, the cleaning device comprises an air flow generating unit for generating an air flow in a space adjacent to the toner control member 3, a cleaning electric field forming unit for forming a cleaning electric field for moving the toner with an electrostatic force away from the toner control member 3, and a control unit for controlling the air flow generating unit and cleaning electric field forming unit so that the air flow is generated and also the cleaning electric field is formed when an image is not being formed.

Figure 6:
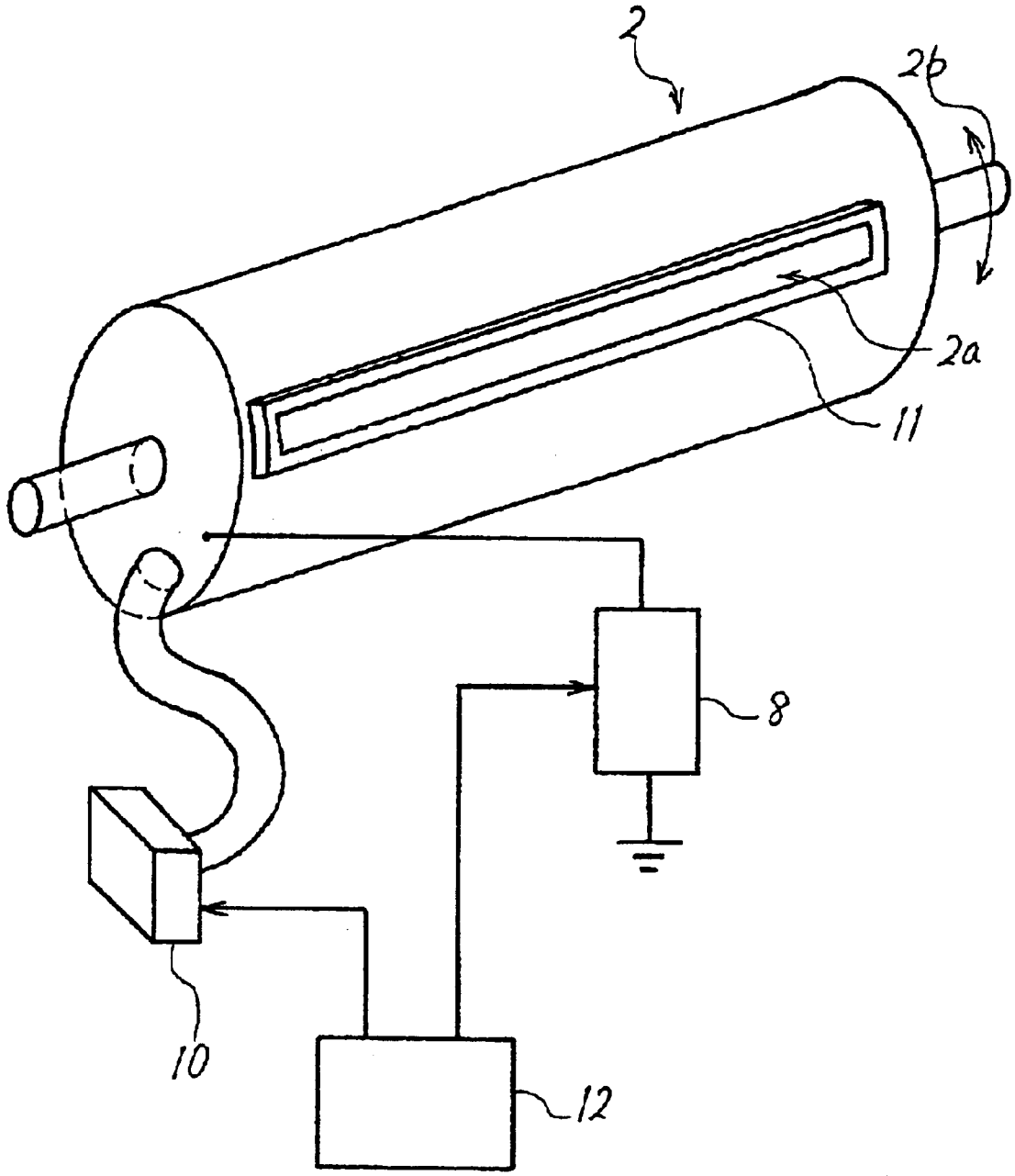
FIG. 6 is a view showing general configuration of a cleaning device in which a counter electrode member in the image forming apparatus according to the present invention is used.

FIG. 6 is a perspective view showing an example of configuration in which the cleaning device is provided on the counter electrode member 2 for reducing a size of the apparatus. Namely, the counter electrode member 2 is used for forming a jet electric field when an image is formed and also as a portion of the cleaning device when an image is not being formed. As shown in FIG. 6, the air flow generating unit in this cleaning unit comprises a counter electrode member 2 also used as a counter member for an air flow having an air flow port for sucking or blowing out an air flow to or from the toner control member 3, and an air flow generating source such as a fan linked to an edge section of the counter electrode member 2. This counter electrode member 2 is rotatably formed, and a slit 2*a* as the air flow port is formed on the outer peripheral surface parallel to the rotation shaft. In this embodiment, the slit 2*a* is formed so that air in the counter electrode member 2 is sucked with the air flow generating source 10, and a pressure inside the counter electrode member 2 is made negative as compared to the atmospheric pressure in the normal state so that air is sucked from the slit 2*a*.

Furthermore, the cleaning electric field forming unit comprises a control electrode 32 for the toner control member 2, a cleaning electrode 11 formed in a convex form around the slit 2*a* of the counter electrode member 2, and a power supply source for applying a voltage for forming a cleaning electric field to a section between the cleaning electrode 11 and the control electrode 32 to the cleaning electrode 11. As the power supply source for cleaning, the power supply source 8 used for applying voltage for forming the jet electric field is used. This power supply source 8 can apply not only a DC voltage for forming the jet electric field, but also an AC voltage with a DC voltage superimposed thereto (described as "DC+AC voltage" hereinafter) for more effectively removing and cleaning off toner on the toner control member 3. In this embodiment, a polarity of toner deposited on a surface of the toner control member 3 is plus, and an air flow is generated so that air is sucked in from the slit 2*a*, so that a minus voltage is applied as the DC voltage. The maximum potential difference, when cleaning is executed, between the control electrode 32 of the toner control member 3 and the cleaning electrode 11 in the side of the counter electrode member 2 is set so that electric discharge will not be generated. The potential difference as described above at which electric discharge is not generated can be obtained by referring to the Paschen's curve, a gape between the control electrode 32 and the cleaning electrode 11, and an air pressure in an area where the cleaning electric field is to be formed.

Also ON/OFF of the air flow generating source such as a fan and a power supply source 8 is controlled by a control section 12. This control section 12 can be formed with a microcomputer comprising, for instance, a CPU, a RAM, a ROM, and an I/O interface. Furthermore, a driving unit not shown in the figure and comprising a motor or the like is connected to a driving shaft 2*b* of the counter electrode member 2 so that also the driving unit can be controlled by the control section 12.

Figure 7:
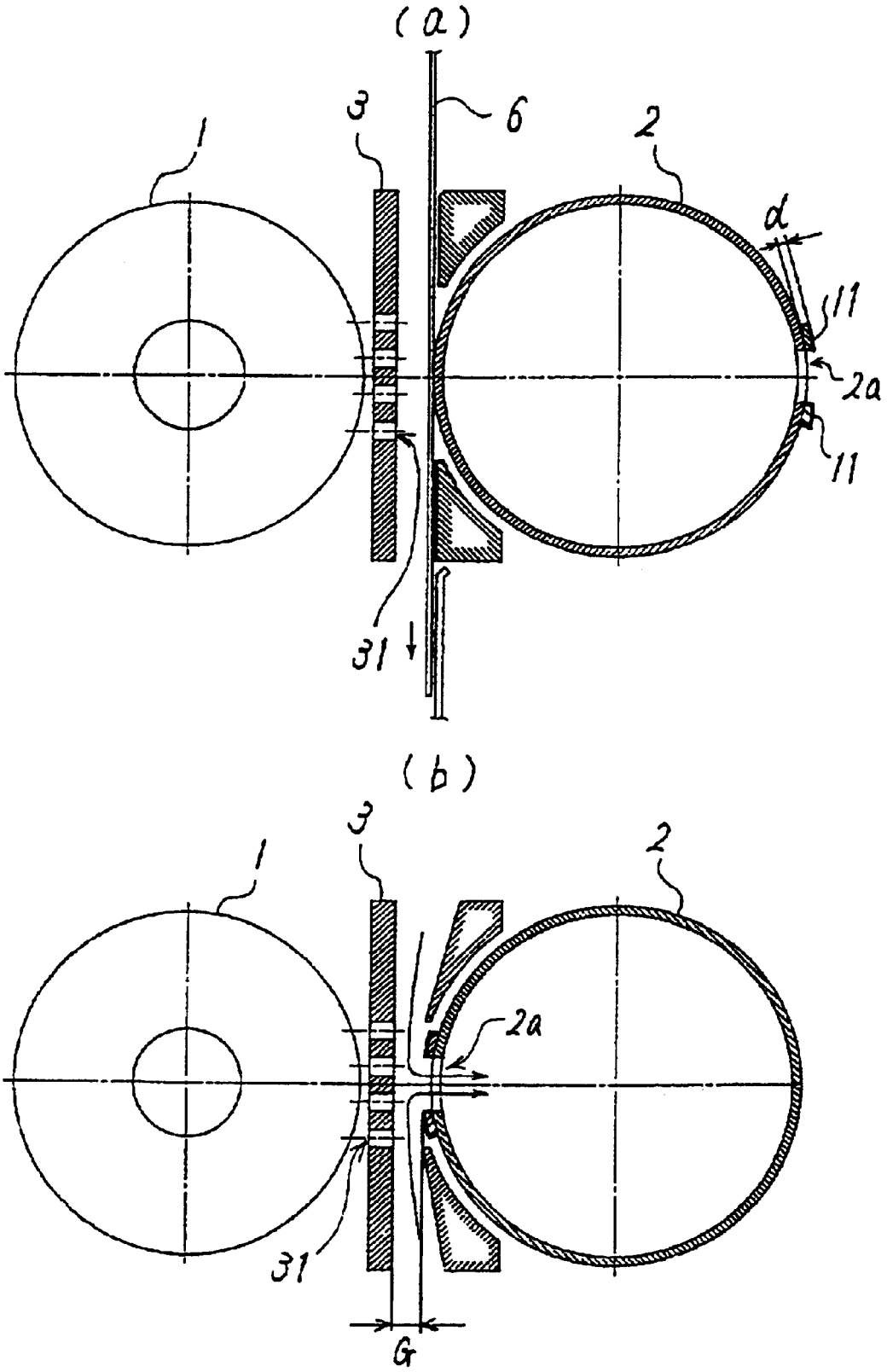
FIG. 7 (*a*) is an explanatory view showing a state of the counter electrode member, when an image is formed, in the image forming apparatus.

FIG. 7(*a*) and FIG. 7(*b*) are explanatory views each for illustrating a cleaning operation by the toner control member 3 in an image forming apparatus having the configuration as described above. In the state as shown in FIG. 7(*a*) when an image is formed, the counter electrode member 2 is driven so that the slit 2*a* of the counter electrode member 2 does not oppose to the toner control member 3 with a specified jet electric field formed between the toner carrier 1 and the counter electrode member 2 and an images formed on the recording paper 6. On the other hand, in the state as shown in FIG. 7(*b*) when an image is not being formed, the air flow generating source 10 is turned ON, and the counter electrode member 2 is driven so that the slit 2*a* of the counter electrode member 2 gets close and apposite to toner control member 3. The power supply source 8 is turned ON after the slit 2*a* of the counter electrode member 2 reaches the position opposing to the toner control member 3. When the slit 2*a* of the counter electrode member 2 reaches the position opposing to the toner control member 3, air flows in the direction as indicated by the arrow because an air pressure inside the counter electrode member 2 is negative. Furthermore, a DC+AC voltage is applied to the electrode 11 provided around the slit 2*a* for cleaning, and a cleaning electric field for driving the positively charged toner deposited on the toner control member 3 to the slit 2*a* is formed. The air flow and cleaning electric field are effected simultaneously to clean a surface of the toner control member 3. The toner as an object for cleaning is not only toner clogged in the hole 31 of the toner control member 3, but also that deposited on a surface of the toner control member 3 in the side of the counter electrode member 2.

As described above, with the image forming apparatus according to this embodiment of the present invention, cleaning with an air flow and that with an electrostatic force are executed to the toner control member 3, so that, different from a case where cleaning is executed only with an air flow, excellent cleaning capability can be obtained even with a small size air flow generating source. By using, for instance, a small-sized fan generally used in business equipment such as a printer, a copying machine, or a personal computer as an air flow generating source to generate a negative pressure of around 15 mm ($H_2O$), an excellent cleaning performance can be obtained. Also as compared to a case where cleaning is executed only with an electric field, a cleaning electric field can be formed with a safe and low voltage not causing electric discharge, so that an excellent cleaning performance can be obtained in the state where electric discharge is not generated.

Further more, with the image forming apparatus according to the present invention, as magnetic force is not used for cleaning the toner control member 3, excellent cleaning capability can be obtained even for non-magnetic toner.

With the image forming apparatus according to the present invention, the cleaning with an air flow as well as with an electric field is executed when an image is not being formed, so that an image formed on the recording paper 6 is not disturbed like in a case where cleaning is executed when an image is being formed.

Working Models

In the next, description is made for more specific Working models of the cleaning device in which the image forming apparatus according to this embodiment is employed with reference to samples for comparison. In the embodiments and examples for comparison described below, an aluminum roller with a diameter of 38 mm is used as the toner carrier 1, and also an aluminum roller with a diameter of 50 mm is used as the counter electrode member 2. The slit 2*a* with a width of 1 mm is formed in a portion of an outer peripheral surface of the counter electrode member 2. Further more, a gap between the counter electrode member 2 and toner control member 3 is 0.4 mm.

Working Example 1

An area around the slit 2*a* of the counter electrode member 2 was made to rise by 0.2 mm as the cleaning electrode 11, and a gap between a surface of this cleaning electrode 11 and a surface of the toner control member 3 was set to 0.2 mm. Furthermore, a fan as an air flow generating source was connected to the counter electrode member 2, and an air pressure inside the counter electrode member 2 was set to a negative pressure of around 15 mm ($H_2O$) . And toner on the toner control member 3 was cleaned with a force generated by an air flow sucked from the slit 2*a* by rotating the counter electrode member 2 with a negative air pressure therein at a speed of 200 msec per rotation to bring the slit 2*a* of the counter electrode member 2 opposite to a surface of the tenor control member 3. As the counter electrode member 2 is rotated at the speed of 200 msec per rotation, it can be guessed that the time for cleaning is around 10 msec.

Figure 8:
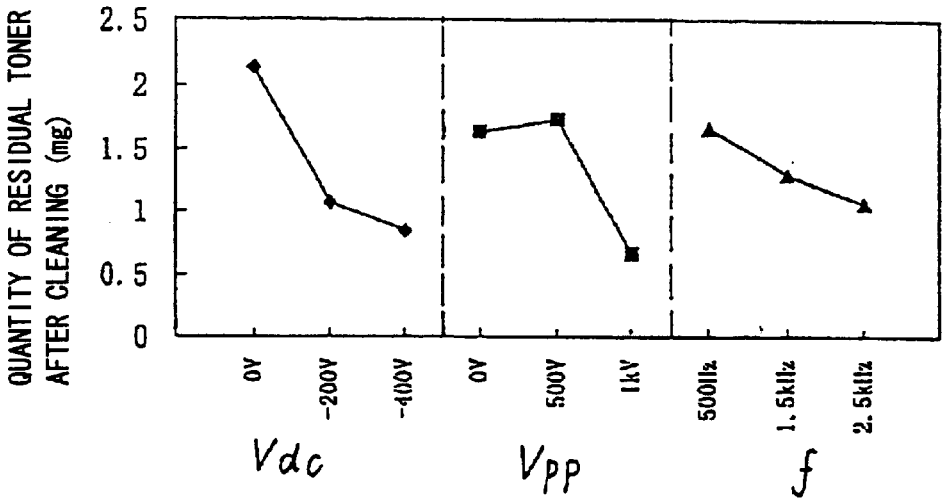
FIG. 8 is a view showing a relation between a cause and the effect in a cleaning test based on the L9 experimental design in Working Model 1.

The DC+AC voltage applied to the cleaning electrode 11 of the counter electrode member 2 was set to the 9 conditions as shown in Table 1 below. Vdc (V) in Table 1 indicates a value of a DC component, while Vpp(V) and f(kHz) indicate an inter-peak voltage and a frequency of an AC component. The air flow was generated to a substantially constant quantity of toner deposited on a surface of the toner control member 3, cleaning test based on the so-called L9 experimental design was executed under the conditions where the 9 types of voltage shown in Table 1 were applied, and a quantity m(mg) of residual toner in each cleaning test was measured. Also a result of the measurement is shown in Table 1. FIG. 8 is a view showing a relation between a factor and an effect in the cleaning test based on the L9 experimental design in the present Working Model 1.

TABLE 1

| Experiment No. | Vdc (V) | Vpp (V) | F (kHz) | m (mg) |
|---|---|---|---|---|
| 1 | 0 | 0 | 0 | 2.8 |
| 2 | 0 | 500 | 1.5 | 2.7 |

TABLE 1-continued

| Experiment No. | Vdc (V) | Vpp (V) | F (kHz) | m (mg) |
|---|---|---|---|---|
| 3 | 0 | 1000 | 2.5 | 0.9 |
| 4 | −200 | 0 | 0 | 1.3 |
| 5 | −200 | 500 | 0.5 | 1.5 |
| 6 | −200 | 1000 | 1.5 | 0.4 |
| 7 | −400 | 0 | 0 | 0.8 |
| 8 | −400 | 500 | 2.5 | 1.0 |
| 9 | −400 | 1000 | 0.5 | 0.7 |

The optimal conditions shown Table 1 and FIG. 8 obtained from the L9 experimental design include Vdc of −400 V, Vpp of 1000 V, and f of 2.5 kHz, and the quantity of residual toner was 0.15 mg. In practice, a result of measurement under the optimal conditions was 0.2 mg. Also under the optimal conditions, an experiment for forming an image on 1000 sheets of recording paper continuously was carried out, but clogging of the holes 31 of the toner control member 3 was not observed. Namely by combining a negative pressure (of 15 mm ($H_2O$)) generated by a fan used in business equipment with the AC+DC electric field, the toner control member 3 could be cleaned under stable conditions.

It should be noted that, although the counter electrode member 2 was used as a cleaning unit for cleaning the toner control member 3, a cleaning unit may be provided independently from the counter electrode member and the counter electrode member 2 may be moved for escaping when cleaning is executed to be replaced with the cleaning unit for cleaning.

In Working Model 1 above, a DC+AC voltage having a polarity reverse to that of the voltage applied to the cleaning electrode 11, for instance, when a DC+AC voltage consisting of Vdc of +400 V and Vpp of 1000 V is applied to the control electrode 32 of the toner control member 3 and the counter electrode member 2 is grounded, a similar cleaning electric field is formed in a space between the slit 2*a* and the toner control member 3. However, when a high voltage like this is applied to the control electrode 32, electronic parts such as the ICs in an electric circuit connected to the control electrode 32 may be damaged. Namely, a voltage for forming the cleaning electric field is required to be applied to the cleaning electrode 11. However, a portion of the voltage for forming the cleaning electric field may be applied to the control electrode 32 within the voltage resistance of the electronic parts such as ICs of the electric circuit connected to the control electrode 32.

Also it has been turned from the figure (FIG. 8) showing a relation between a cause and an effect in the L9 experimental design in the cleaning test in Working Model 1 that the voltage applied to the cleaning electrode 11

(1) should preferably include a DC component and the DC component should preferably be larger within a range of the cleaning test, (2) should preferably include also an AC component and the inter-peak voltage should preferably be larger within a range of the cleaning test, and (3) that the frequency of the AC component should preferably be higher within a range of the cleaning test.

Working Model 2

In Working Model 2, cleaning test based on the L9 experimental design was carried out under the voltage-applied conditions shown in Table 2 below to know a limit of an amplitude of the cleaning electric field in which the electric discharge is not generated in the state where an air flow with a negative pressure of 15 mm ($H_2O$) was generated in Working Model 1 above.

TABLE 2

| | | Voltage level | | |
|---|---|---|---|---|
| | | First level | Second level | Third level |
| Cause | Vdc | 0 V | −250 V | −500 V |
| | Vpp | 1.0 kV | 1.5 kV | 2.0 kV |
| | F | 0 kHz | 1 kHz | 2 kHz |

Figure 9:
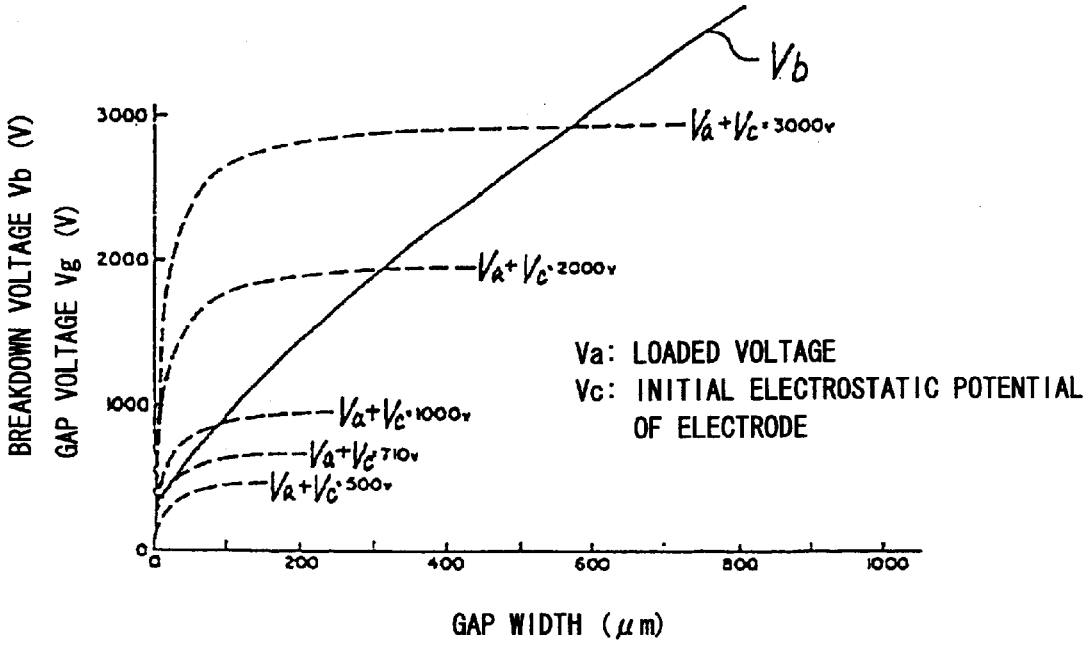
FIG. 9 is a characteristic view showing the Paschen's curve.

When absolute value of the maximum value of the AC+DC voltage applied to the cleaning electrode I1 during the cleaning test exceeded 1000 V, namely the value is 1250 V, or 1500 V, electric discharge occurred between the control electrode 32 of the toner control member 3 and the counter electrode member 3, and in extreme cases an excessive current flew in and melted down and disconnected the Cu electrode wire formed on the toner control member 3. This result can easily be explained from the Paschen's curve against a wide gap shown in FIG. 9. Namely, when the gap is 0.2 mm (200 $\mu$m), the potential difference of 1250 V is close to a point on the discharge curve where electric discharge is started.

From a result of the experiments in Working Model 2 as well as from consideration on the result, it can be understood that an absolute value of the maximum value of the AC+DC voltage applied to the cleaning electrode I1 must be below the Paschen's discharge curve.

Working Model 3

As understood from the examples for comparison 1 and 2 described below, the cleaning capability with an air flow (negative pressure) is far better when a gap between the toner control member 3 and the counter electrode member 2 is 0.2 mm as compared to that when the gap is 0.4 mm. Also as for the cleaning electric field, from the Paschen's curve, the maximum voltage which can be applied to the cleaning electrode 11 is around 1300 V when the above gap is 0.2 mm, and around 2100 V when the gap is 0.4 mm, so that the cleaning electric field is $6.5\times10^6$ V/m and $5.2\times10^6$ V/m respectively. For this reason, it is advantageous to set the gap to 0.2 mm.

Therefore, in Working Model 3, not only the portion of cleaning electrode 11 was made to rise more, but also a diameter of the counter electrode member 2 was made larger by 0.2 mm, and a gap between the toner control member 3 and counter electrode member 2 when an image was formed was reduced from 0.4 mm to 0.2 mm. However, if a number of recording paper were printed continuously, paper jamming was frequently generated. Jamming was also generated when the gap was widened by 0.3 mm.

Therefore, the gap was returned to 0.4 mm with a negative pressure inside the counter electrode member 2 set to 15 mm ($H_2O$) and a DV+AC voltage (Vdc=−1000 V, Vpp=2000 V, f=2 kHz) was applied to the counter electrode member 2 (cleaning electrode 11) for cleaning, and a quantity of residual toner was 0.6 mg. Under these conditions 1000 sheets of recording paper were continuously printed, and clogging occurred when the 900-th sheet was being printed.

Again the gap was returned to 0.3 mm and the DC+AC voltage (Vdc=−750 V, Vpp=1500 V, and f=2 kHz) was applied to the counter electrode member 2 (cleaning electrode 11) for cleaning, and then a quantity of residual toner was 0.4 mg, and clogging was not generated even when 1000 sheets of recording paper were continuously printed.

From a result of experiment in Working Model 3 above, it is understood that for stable cleaning under a negative pressure of 15 mm ($H_2O$) without generation of paper jamming, a gap between the toner control member 3 and the counter electrode 2 (cleaning electrode 11) when cleaning is executed should preferably be made smaller as compared to that when an image is formed (or when recording paper is being carried). Also it is understood that the gap should preferably be 0.3 mm or below.

Working Model 4

Figure 10:
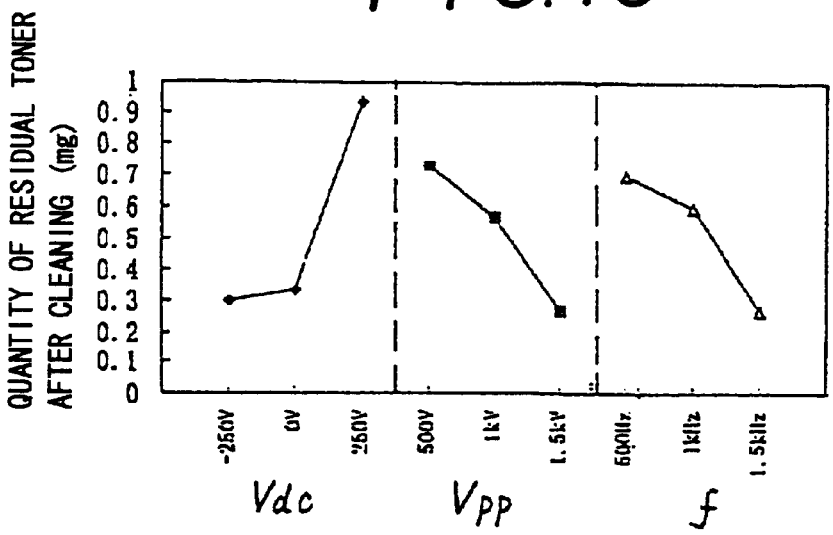
FIG. 10 is a view showing a relation between a cause and the effect in a cleaning test according to the L9 experimental design in Working Model 4.

In Working Model 4, to know a relation between a polarity of charged residual toner on the toner control member and a polarity of the cleaning electric field, cleaning test was carried out based on the L9 experimental design in the state where an air flow under the negative pressure of 15 mm ($H_2O$) like in Working Model 1 and the voltage shown in Table 3 was applied. It should be noted that the counter electrode member 2 with a cleaning electrode 11 having a thickness of 0.2 mm formed thereon was used so that a gap between the toner control member 3 and counter electrode member 2 was 0.2 mm. FIG. 10 is a view showing a relation between a cause and the effect in the cleaning test based on the L9 experimental design in Working Model 4.

TABLE 3

| | | Voltage level | | |
|---|---|---|---|---|
| | | First level | Second level | Third level |
| Cause | Vdc | −250 V | 0 V | +250 V |
| | Vpp | 0.5 kV | 1.0 kV | 1.5 kV |
| | f | 0.5 kHz | 1 kHz | 1.5 kHz |

From FIG. 10 showing a relation between a cause and the effect, it is understood that, in the configuration as that in Working Model 4, a polarity of a DC component of a voltage for forming a cleaning electric field must be opposite to that of toner to be cleaned. Of course, in a case where air is not sucked under a negative pressure like in Working Model 4 but is blown to the toner control member 3, the polarity must be the same as that of toner to be cleaned.

Working Model 5

Figure 11:
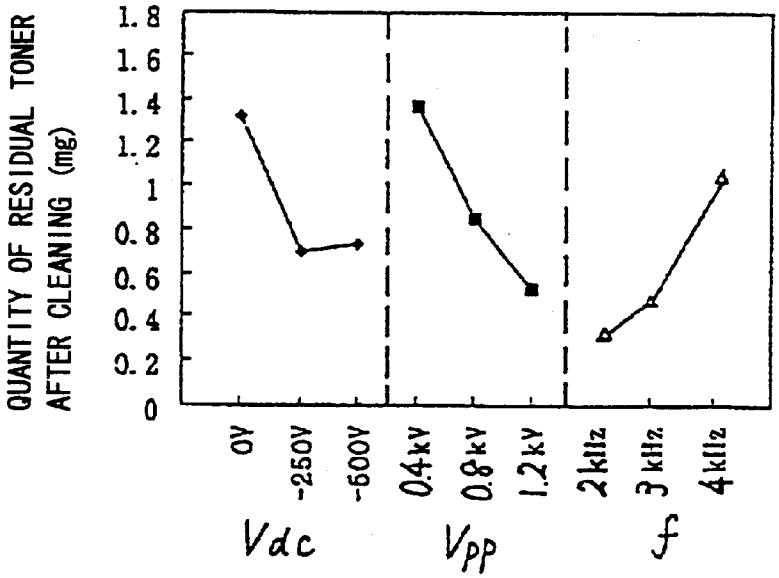
FIG. 11 is a view showing a relation between a cause and the effect in a cleaning test according to the L9 experimental design in Working Model 5.

In Working Model 5, to know an optimal frequency of an AC voltage for cleaning, cleaning test based on the L9 experimental design was carried out in the state where a voltage as shown in Table 4 was applied in the state where an air flow for a negative pressure of 15 mm ($H_2O$) was generated like in Working Model 1. Also in Working Model 5, the counter electrode member 2 with a cleaning electrode 11 having a thickness of 0.2 mm formed thereon was used so that a gap between the toner control member 3 and the counter electrode member 2 was 0.2 mm. FIG. 11 is a view showing a relation between a cause and the effect in the cleaning test based on the L9 experimental design in Working Model 5.

TABLE 4

| | | Voltage level | | |
|---|---|---|---|---|
| | | First level | Second level | Third level |
| Cause | Vdc | 0 V | −250 V | −500 V |
| | Vpp | 0.4 kV | 0.8 kV | 1.2 kV |
| | f | 2 kHz | 3 kHz | 4 kHz |

From FIG. 11 showing a relation between a cause and the effect and the view showing a relation between a cause and the effect for the frequency f in Working Models 1 and 2, it is understood that optimal value of a frequency of an AC component of a voltage applied to the cleaning electrode 11 is around 2 kHz and a value in a range from 0.5 kHz to 3.0 kHz is allowable.

Working Model 6

During the cleaning test carried out in Working Models 1 to 5, sometimes a rear surface of recording paper as a sample for image formation was contaminated by toner. At first the cause for contamination was not clear, but the present inventor and other related persons made investigation and found out that, as the power 8 for generating a cleaning electric field was turned ON while the counter electrode member 2 was rotated for cleaning, the distance was larger and the cleaning electric field was weak, and a portion of WST on the toner control member 3 was cleaned, flown, and deposited on the counter electrode member 2 even if a negative pressure was not generated in the counter electrode member 2, and the deposited toner stuck to a rear surface of the recording paper to cause the contamination.

Therefore, in Working Model 6, a DC+AC voltage for cleaning was applied to the counter electrode member 2 at a timing when the counter electrode member 2 was rotated to bring the slit 2*a* close to WST on the toner control member 3 with a negative pressure generated therein. As a result, all the toner cleaned off was recovered into the counter electrode member 2 because of the negative pressure therein, and the contamination of a rear surface of the recording paper 6 generated during formation of an image was eliminated.

Example for Comparison 1

Figure 12:
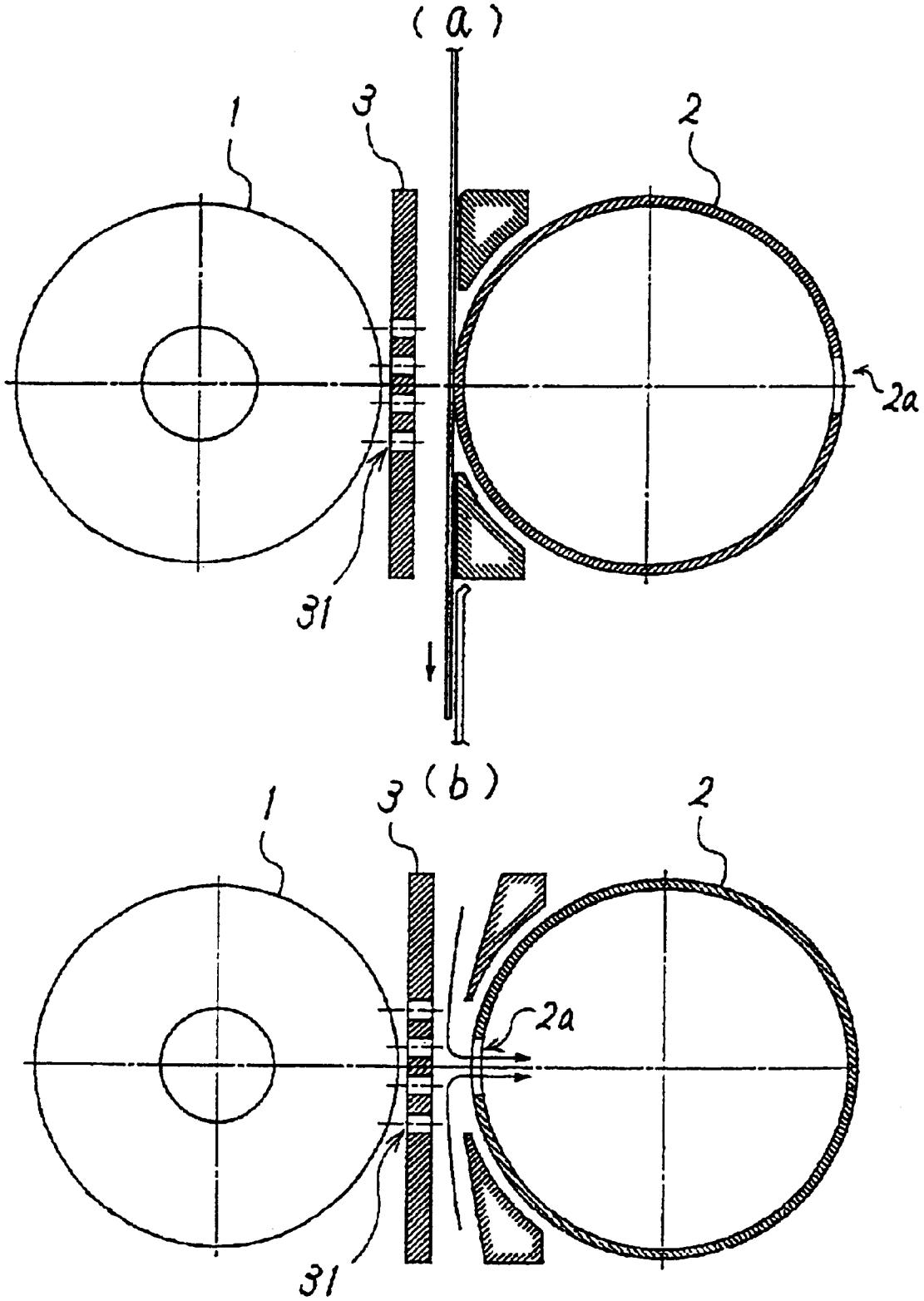
FIG. 12(*a*) is an explanatory view showing a state of a counter electrode member, when an image is formed, in the image forming apparatus in the Example for Comparison 1.

As an example for comparison with each of the working models described above, in this Example for Comparison 1, a vacuum pump as an air flow generating source was connected to the counter electrode member 2 and a negative pressure was generated inside the counter electrode member 2. As shown in FIG. 12(*a*), the cleaning electrode 11 around the slit 2*a* of the counter electrode member 2 was not made to rise, and a gap between a surface of the cleaning electrode 11 and a surface of the toner control member 3 was set to 0.4 mm. The counter electric member 2 was rotated in the state where a negative pressure had been generated inside the counter electrode member 2 to locate the slit 2*a* of the counter electrode member 2 at a position opposing to the toner control member 3 as shown in FIG. 12(*b*), and cleaning was carried out. And in this Example for Comparison 1, the negative pressure was changed to three levels in a range from 200 mm ($H_2O$) to 90 mm ($H_2O$), a quantity of residual toner after cleaning was measured, and the measured quantity was compared to a value before cleaning to compute the cleaning efficiency. Also under the conditions described above, 1000 sheets of recording paper were printed continuously by executing cleaning after every sheet of recording paper printed, and lacking of an image due to clogging was checked. The result is as shown in Table 5.

TABLE 5

| Negative Pressure (mm ($H_2O$)) | Quantity of Residual toner (mg) | Efficiency (%) | Clogging |
|---|---|---|---|
| 200 | 0.2 | 98 | Not generated |
| 150 | 0.2 | 98 | Not generated |
| 90 | 1.2 | 88 | Generated |

From the result shown in Table 5, it is understood that, to realize the excellent cleaning capability in the configuration not using an electric field like in Working Model 1, a negative pressure in the counter electrode member 2 should be set to 150 mm ($H_2O$). Also cleaning was carried out by rotating the counter electrode member 2 not only once but several times in the state where a negative pressure inside the counter electrode member 2 had been set to 90 mm ($H_2O$), but the result changed a little. It is understood that cleaning can not be carried out even if the cleaning time is made longer.

Generally a negative pressure, which can be realized by a small-sized fan used in OA equipment such as a printer, a copying machine, or a personal computer, is 15 mm ($H_2O$). When a large-sized fan or a vacuum pump which can generate a negative pressure of 150 mm ($H_2O$) is used like in the Example for Comparison 1, a size of the apparatus becomes larger with the cost increased, and also the noises become higher, so that such an image forming apparatus can not be used in ordinary offices.

Example for Comparison 2

In the Example for Comparison 2, as shown in FIG. 7 showing the present embodiment, an area around the slit 2*a* of the counter electrode member 2 was made to rise by 0.2 mm to form the cleaning electrode 11, and a gap between this cleaning electrode 11 and the toner control member 3 was narrowed from 0.4 mm to 0.2 mm. And like in the example for comparison 1 described above, a negative pressure inside the counter electrode member 2 was changed in 4 levels in a range from 90 mm ($H_2O$) to 15 mm ($H_2O$), and the cleaning efficiency and generation of clogging were checked. The result is shown in Table 6 below.

TABLE 6

| Negative Pressure (mm ($H_2O$)) | Quantity of Residual toner (mg) | Efficiency (%) | Clogging |
|---|---|---|---|
| 90 | 0.1 | 99 | Not generated |
| 45 | 0.6 | 94 | Generated |
| 30 | 1.5 | 85 | Generated |
| 15 | 1.9 | 81 | Generated |

From the result shown in Table 6, it is understood that, even if a gap between the toner control member 3 and counter electrode member 2 (cleaning electrode 11) is narrowed to 0.2 mm, a high negative pressure of 90 mm ($H_2O$) is required. Although the gap is narrowed further, the gap can not be reduced to a level where the cleaning efficiency of 98% or more can be achieved without generating clogging under the negative pressure of 15 mm ($H_2O$). Namely, it is understood that cleaning only with an air flow is impossible in a range of negative pressure which can be generated by a small-sized fan incorporated in any business equipment.

Example for Comparison 3

In the example for comparison 3, in the configuration of the example for comparison 2 described above, a negative pressure in the counter electrode member 2 was set to 0 mm ($H_2O$), and a voltage for cleaning different from +1.2 k V applied when an image was formed was applied to the counter electrode member 2. A quantity of residual toner after cleaning when the DC voltage Vdc as this cleaning voltage, AC inter-peak voltage Vpp, and frequency f were changed is shown in Table 7 below.

TABLE 7

| Experiment No. | Vdc (V) | Vpp (V) | f (kHz) | m (mg) |
|---|---|---|---|---|
| 1 | −100 | 0 | 0 | 3.4 |
| 2 | −100 | 500 | 1 | 3.8 |
| 3 | −100 | 1000 | 1.5 | 1.6 |
| 4 | −300 | 0 | 0 | 2.5 |
| 5 | −300 | 500 | 0.5 | 3.2 |
| 6 | −300 | 1000 | 1 | 1.4 |
| 7 | −500 | 0 | 0 | 2.5 |
| 8 | −500 | 500 | 1.5 | 1.8 |
| 9 | −500 | 1000 | 0.5 | 1.1 |

The optimal combination of parameters obtained according to the L9 experimental design shown in Table 7 is: Vdc=−500 V, Vpp=1000 V, and f=1.5 kHz, and an estimated quantity m of residual toner under the conditions is 1.3 mg. From the Examples for Comparison 1 and 2, it can be considered that a quantity of residual toner allowing stable cleaning is 0.4 mg or below, and for this reason it is anticipated that clogging of the holes 31 of the toner control member 3 will easily occur under the conditions described above. Actually, when printing was executed continuously under the optimal combination of the parameters above, clogging occurred when a several tens of sheets of recording paper were continuously printed. From the result above, it is also understood that cleaning with only an electric field is impossible.

EMBODIMENT 2

Figure 13:
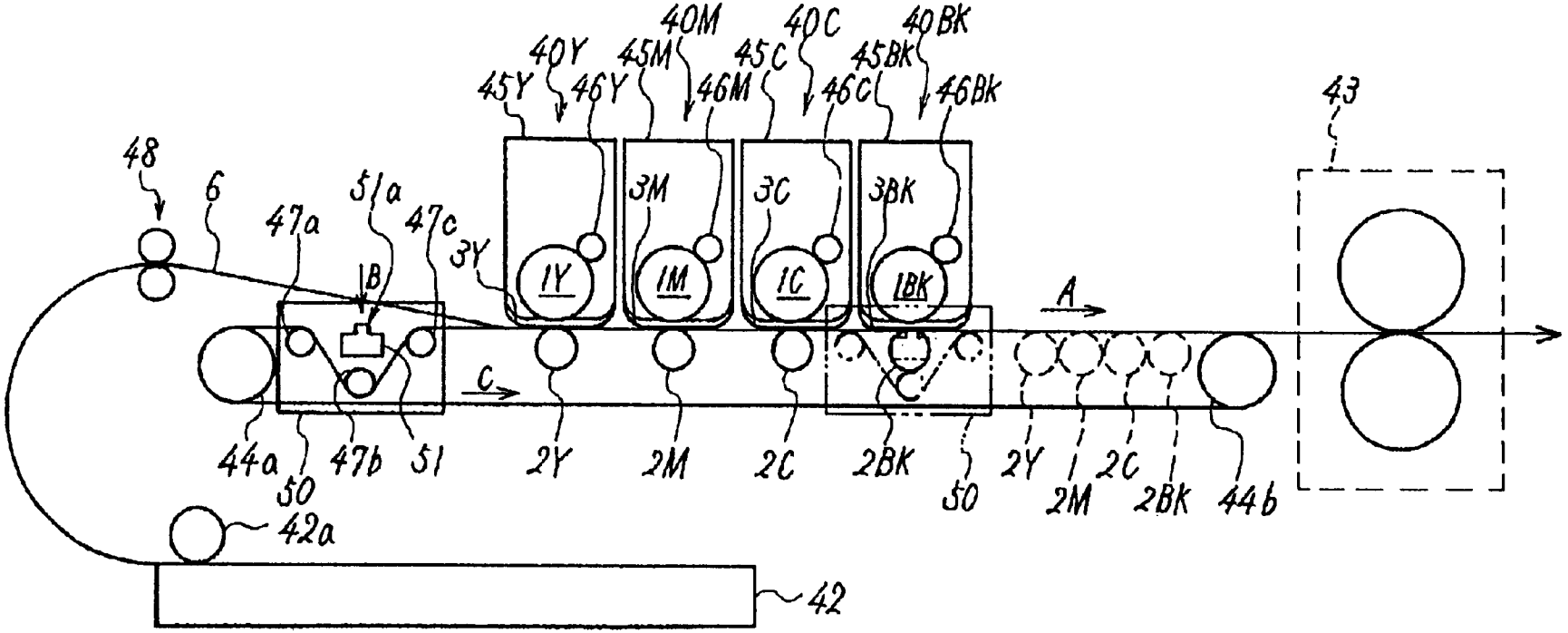
FIG. 13 is a front view showing general configuration of the image forming apparatus according to another embodiment of the present invention.

FIG. 13 is a front view showing general configuration of an image forming apparatus according to Embodiment 2 of the present invention. This image forming apparatus has 4 sets of image sections each forming an image on recording paper 6 by flying toner as an electrically charged powder as image forming substance via the toner control member 3 as a powder control member having toner passage holes towards recording paper 6 as a recording medium, and selectively allowing passage of toner flying towards the recording paper 6 through the powder passage holes according to image information. Also the image forming apparatus has paper carrier belt 41 as a belt movable in the direction A in the figure along image forming positions of the image forming sections 40Y, 40M, 40C, and 40BK, and a belt driving unit for driving the paper carrier belt 41. The image forming apparatus further comprises a paper feed cassette 42 with blank recording paper set therein, and a fixing unit 43 consisting of a set of fixing rollers each for fixing a toner image formed on the recording paper 6. The paper carrier belt 41 is spanned over the belt driving unit, and the belt driving unit comprises a pair of supporting rollers 44*a*, 44*b*, at least one of which is a driving roller, and a rotating unit not shown herein for driving one of the supporting rollers 44*a*, 44*b*, which is a driving roller.

The image forming sections 40Y, 40M, 40C, 40BK forms toner images with yellow toner (Y), magenta toner (M), cyan toner (C), and black toner (BK) respectively on the recording paper 6.

Each of the image forming sections has the substantially same configuration, and comprises a sleeve-shaped toner carrier 1 as a powder supporting body, a counter electrode member 2 arranged at a position opposing to the toner carrier 1, a jet electric field forming unit for forming a jet electric field for flying the toner on the toner carrier 1 towards the counter electrode member 2, a hole for controlling jet of the toner from the toner carrier 1 to the counter electrode member 2 between the toner carrier 1 and the counter electrode member 2, and a toner control member 3 having a control electrode provided in a space around the hole. The jet electric field forming unit comprises a power supply unit not shown herein for applying a specified voltage, the unit provided the toner carrier 1 and the counter electrode member 2. Also the jet electric field forming unit comprises a power supply unit not shown herein for applying a voltage to the control electrode according to image information. Suffixes Y, M, C, and BK are assigned to the 4 types of toner corresponding to the 4 colors respectively to the image forming sections in FIG. 13.

The toner carrier 1 above is provided in a toner hopper 45 with toner accommodated therein, and contacts a supply roller 46 for supplying toner in the toner hopper 45. It should be noted that configuration of the toner control member 3 and control of toner jet are the same as those in the image forming apparatus according to Embodiment 1 of the present invention, and that description thereof is omitted herein.

In the image forming apparatus, a cleaning device 50 for cleaning each toner control member 3 is provided between a cleaning position opposing to each toner control member 3 and an escaping position off from the image forming position so that it can move along the paper carrier belt 41. The paper carrier belt 41 is spanned over three rollers 47*a*, 47*b*, 47*c* each as a rotatably rotating body, and a portion of the paper carrier belt 41 is turned around in a direction opposite to a direction in which the paper carrier belt 41 opposing to the toner control member 3. A cleaning head 51 as a cleaning member is provided in the turning-around area of this paper carrier belt 41. The. cleaning device 50 generates an air flow in a space adjacent to the toner control member 3 when it faces the toner control member 3, and also forms a cleaning electric field for moving the toner away from a surface of the toner control member 3 to clean off toner deposited on the toner control member 3 in a non-contact form with a combination of an air flow and an electrostatic force, and this cleaning device 50 has an air flow port 51*a* and an electrode not shown herein for forming a cleaning electric field in a section opposing to the toner control member 3 of the cleaning head 51. Toner is sucked together with air as indicated by the arrow B in the figure from this air flow port 51*a*.

Furthermore, the image forming apparatus has a driving unit not shown herein as an escaping unit for moving each of the counter electrode members to an escaping position off from a moving path of the cleaning device 50.

When an image is formed with the image forming apparatus having the configuration as described above, recording paper 6 is supplied by a paper supply roller 42*a* or the like from the paper feed cassette 42, and the recording paper 6 passes through guide plates not shown and is carried to the upper section in the figure. This recording paper 6 is fed by the carrier roller 48 as well as by the paper carrier belt 41 to a section as an image forming position between the counter electrode member 2 and the toner control member 3 provided outside the toner hopper 45. In each image forming section 40, each type of toner having a respective color flying from the toner carrier 1 via a hole of the toner control member 3 to the counter electrode member 2 is controlled by a control electrode provided around the hole of the toner control member 3, and the toner having partially flown is deposited on the recording paper 6 on the paper carrier belt 41, thus a color image is formed. The recording paper 6 with a color image having been formed thereon is fed to the fixing device 43, and the toner deposited on the recording paper 6 is fixed.

After the recording paper 6 has passed through the counter electrode member 2BK of the final image forming section 40BK and the toner control member 3BK, when an image is not being formed, the cleaning device 50 is moved by a driving unit not shown in a direction indicated by the arrow C. In association with movement of this cleaning device 50, each counter electrode member 2 positioned inside the paper carrier belt 41 is moved to an escaping position in the side of the fixing device 43.

When the cleaning device 50 has moved to the cleaning position, a cleaning electric field is formed by a voltage applied to an electrode not shown but provided on the cleaning head 51, the toner is separated and moved by the cleaning electric field from a surface of the toner control member 3, and the toner is sucked together with air in the direction as indicated by the arrow B from the air flow port 51*a* of the cleaning head 51 opposing to the toner control member 3,.

After each toner control member 3 has been cleaned, the cleaning device 50 escapes to an escaping position in the left side of the figure.

As described above, with the image forming apparatus according to this embodiment, even in a case where the cleaning device 50 enabling non-contact cleaning not causing damages due to friction is used, it is possible to clean each toner control member 3 by successively moving the cleaning device 50 to a cleaning position opposing to each toner control member 3, so that each toner control member 3 can be cleaned better with a smaller number of parts as compared to a case where 4 units of cleaning device are provided for the toner control members. Also an escaping position for the cleaning device can be provided on a moving path of the paper carrier belt 41, so that the size of the apparatus can be minimized.

Also with the image forming apparatus according to the present Embodiment, by successively moving the cleaning device to cleaning position opposing to the toner control members along the paper carrier belt 41, each toner control member 3 is cleaned, so that a moving path of the paper carrier belt 41 is the same as that of the cleaning device 50, which makes it possible to reduce a size of the apparatus.

Furthermore, with the image forming apparatus according to the present embodiment, the cleaning head 51 provided in a turning-around area of the paper carrier belt 41,) can successively be moved to a cleaning position opposing to the toner control member 3 of each image forming section 40, so that it is not necessary to acquire a space for providing the cleaning head 51 at a place off from the moving path of the paper carrier belt 41, which enables further reduction in the number of required parts as well as further size reduction of the apparatus.

It should be noted that, in this embodiment, configuration is allowable in which the rollers 47*a*, 47*b*, 47*c* for turning around the paper carrier belt 41 may be set in a rotatable state or in a restricted state where rotation is restricted. In this case, with a slave state switching mechanism not shown in the figure, when the toner control member 3 is cleaned and an image is not being formed, the rollers 47*a*, 47*b*, 47*c* are set in the rotation-restricted state to set the cleaning device in the slave state where the cleaning device 50 follows movement of the paper carrier belt 41. With this an mechanism, the cleaning device 50 can be moved to a cleaning position for each toner control member 3 by rotating and driving the paper carrier belt 41. On the other hand, by setting the rollers 47*a*, 47*b*, 47*c* in the idling state, the slave state of the cleaning device 50 with the paper carrier belt 41 can be released. With this operation, the cleaning device 50 can be fixed at the escaping position. As described above, the cleaning device 50 can be moved by moving the paper carrier belt 41, so that a driving unit required only for moving the cleaning device 50 is not required, which enables reduction in cost of the apparatus. Also as an escaping position for the cleaning device 50 can be set in a moving path of the paper carrier belt 41, so that a size of the apparatus can be minimized.

EMBODIMENT 3

Figure 14:
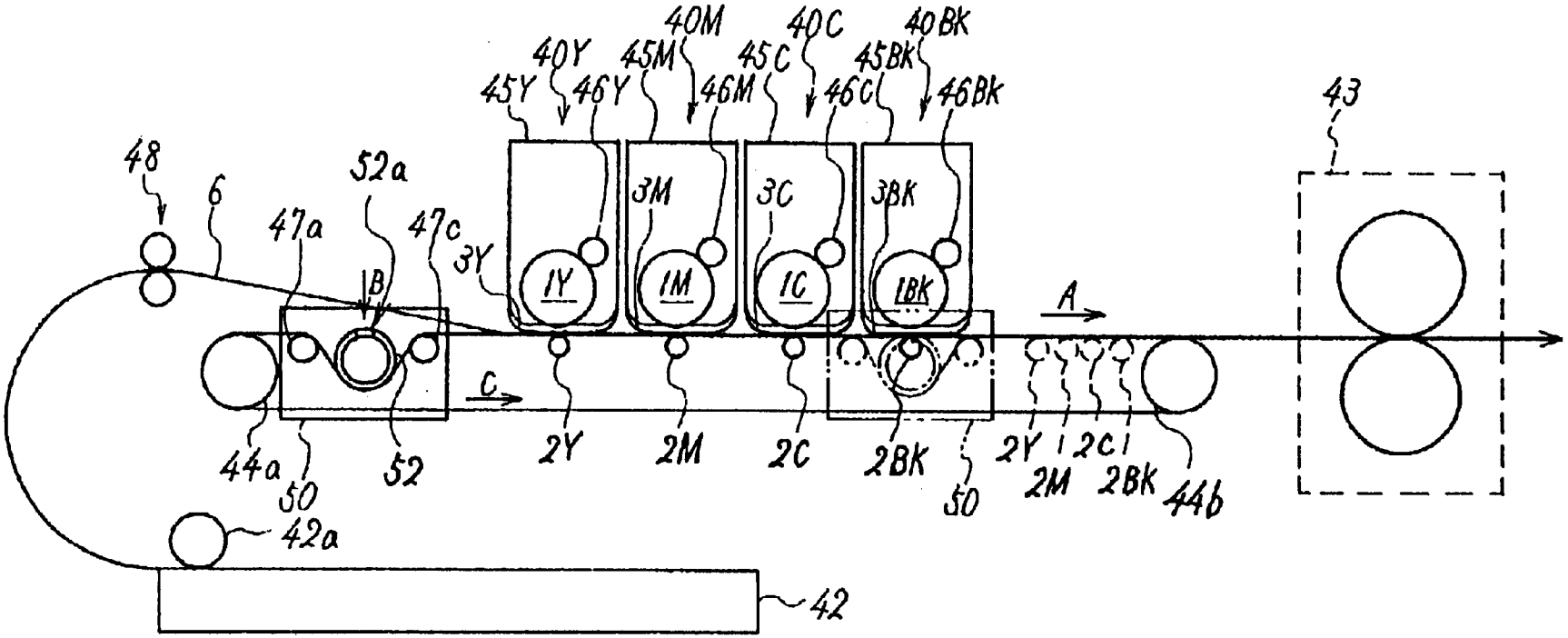
FIG. 14 is a front view showing general configuration of the image forming apparatus according to a further different embodiment of the present invention.

FIG. 14 is a front view showing general configuration of the image forming apparatus according to Embodiment 3 of the present invention. The image forming apparatus has the substantially same configuration as that of the image forming apparatus according to Embodiment 2 of the present invention (refer to FIG. 13), so that the same reference numerals are assigned to the same components as those in Embodiment 2 and description thereof is omitted herein.

In the image forming apparatus shown in FIG. 14, a cylindrical member 52 is used as a cleaning member for cleaning the toner control member 3, and this cleaning member 52 is also used as one of the three rollers as a unit for turning-around the paper carrier belt 41. A slit 52*a* as an outlet for the air flow is formed in the outer peripheral section opposing to the toner control member 3 of the cleaning member 52.

With the image forming apparatus according to this embodiment, a number of rollers for turning-around the paper carrier belt 41 can be reduced by one, so that the number of components required in this apparatus can be reduced further.

EMBODIMENT 4

Figure 15:
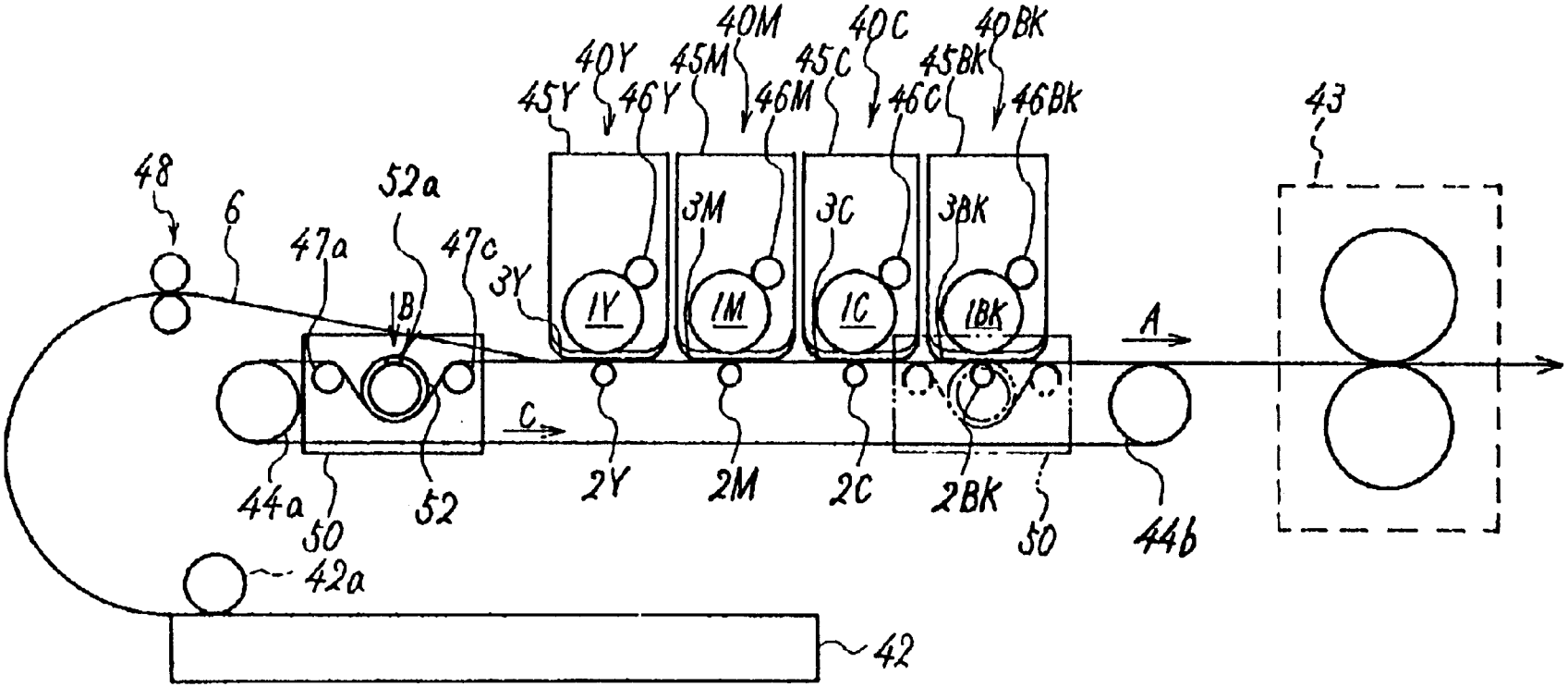
FIG. 15 is a front view showing general configuration of the image forming apparatus according to a still different embodiment of the present invention.

FIG. 15 is a front view showing general configuration of the image forming apparatus according to Embodiment 4 of the present invention. This image forming apparatus has the substantially same configuration as that of the image forming apparatus according to Embodiment 2 of the present invention (refer to FIG. 13), so that the same reference numerals are assigned to the same components as those in Embodiment 2 and description thereof is omitted herein.

In the image forming apparatus shown in FIG. 15, the counter electrode member 2 used in the image forming apparatus shown in FIG. 13 is not provided, and the paper carrier belt 41 is made from a conductive material (such as Ni), and this conductive paper carrier belt 41 is also used as a counter electrode member. Also like in the apparatus shown in FIG. 14, a cylindrical member 52 is used as a cleaning member for cleaning the toner control member 3.

With the image forming apparatus according to this embodiment, the paper carrier belt 41 is used as a common counter electrode member made from a conductive material, so that the number of components required can further be reduced. Also it is not necessary to move the counter electrode member 2 during cleaning to an escaping position like in the image forming apparatus shown in FIG. 13, nor is it required to acquire a space for escaping the counter electrode member 2. Further as it is possible to set an escaping space for the cleaning device 50 also in the side of the fixing device 43, and for this reason it is not required to move the cleaning device 50 to the escaping position in the left side of the figure after cleaning is finished in the final image forming section 40BK. Accordingly, time required for cleaning can be reduced, and the substantial image forming speed can be made higher.

It should be noted that, when the paper carrier belt 41 is made from a conductive material such as Ni like in this embodiment, the voltage applied to the paper carrier belt 41 is discharged in the outside, furthermore the strength decreases, so that it is preferable to provide an insulating layer also functioning as a reinforcing material in the outer peripheral area of the paper carrier belt 41.

EMBODIMENT 5

Figure 16:
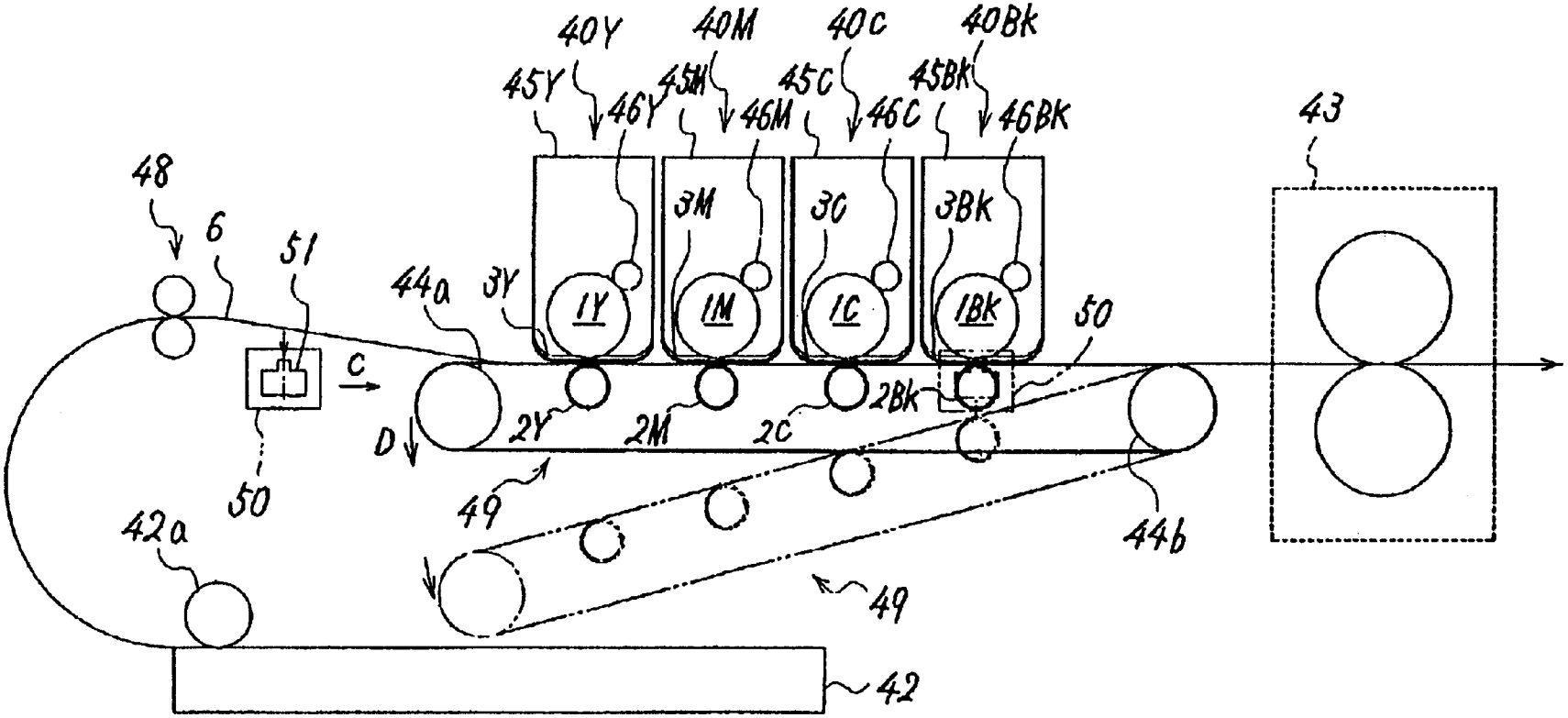
FIG. 16 is a front view showing general configuration of the image forming apparatus according to a still different embodiment of the present invention.

FIG. 16 is a front view showing general configuration of the image forming apparatus according to Embodiment 5 of the present invention. The image forming apparatus has substantially similar configuration as that of the image forming apparatus according to Embodiment 2 described above, and the same reference numerals are assigned to the same components as those in Embodiment 2 with description thereof omitted herein.

In the image forming apparatus shown in FIG. 16, the cleaning device 50 is provided outside the belt unit including the counter electrode member 2 and paper carrier belt 41, and the belt unit is provided so that the belt unit 49 can freely swing around a supporting roller (driving roller) 44*b* as a shaft for swinging in the right side of the figure. When cleaning is executed in this configuration, the belt unit 49 is swung for escaping around the supporting roller (driving roller) 44*b* in a direction indicated by the arrow D. Then the cleaning device 50 is moved in the direction indicated by the arrow C to face it to a toner control member of each image forming section 40.

As described above, with the image forming apparatus according to the present embodiment, the cleaning device 50 for cleaning each toner control member 3 can be moved to the cleaning position without contacting it to the paper carrier belt 41, All so that durability of the paper carrier belt 41 can be improved.

EMBODIMENT 6

Figure 17:
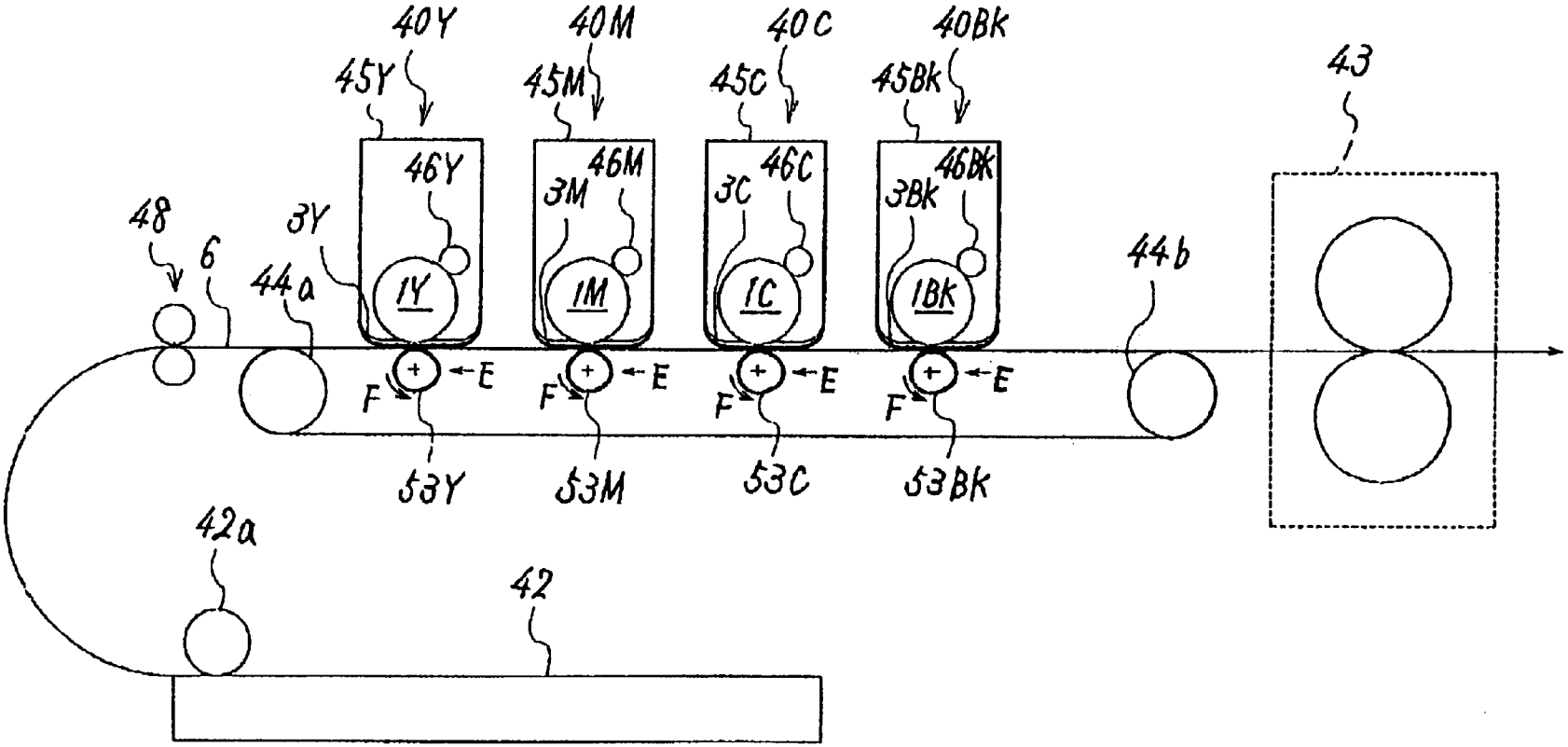
FIG. 17 is a front view showing general configuration of the image forming apparatus according to a still further different embodiment of the present invention.

FIG. 17 is a front view showing general configuration of the image forming apparatus according to Embodiment 6 of the present invention. This image forming apparatus has substantially similar configuration as that of the image forming apparatus according to Embodiment 2 described above (refer to 13), and the same reference numbers are assigned to the same components as those in Embodiment 2 with description thereof omitted herein.

In the image forming apparatus shown in FIG. 17, an opening for cleaning is formed in the paper carrier belt 41, and the counter electrode member is also used as a cleaning member for cleaning the toner control member. As a counter electrode member also used as this cleaning member, egg-formed eccentric rotating members 53Y to 53B each with a distance from an outer peripheral surface of a section used for cleaning and a center of rotation longer than a distance between an outer peripheral surface of other section to the center of rotation, and also there is provided a rotating unit for driving rotation of the eccentric rotating member 53. When cleaning is executed with this image forming apparatus, an opening for cleaning is moved by the paper carrier belt 41 to a position under the toner control member 3 to be cleaned, and at the same time the eccentric rotating member 53 is rotated by about 90 degrees in the direction indicated by the arrow F to face the air flow port on the eccentric rotating member 53 at a position indicated by the arrow E to the toner control member 3 for cleaning. Then all the toner control members 3 are cleaned by successively moving the opening for cleaning with the paper carrier belt 41 to a cleaning position of other image forming section 40.

With the image forming apparatus according to this embodiment, each toner control member 3 can easily be cleaned even if a cleaning device dedicated for cleaning the toner control member 3 in a non-contact form not giving damages due to friction is not provided independently. Also switching between the state for cleaning the eccentric rotating member 53 and the image-formation enabled state giving not interference to the belt member can easily be executed only by rotating the eccentric rotating member 53 also used as a cleaning member.

It should be noted that an edge section of the paper carrier belt 41 and an edge section of the opening for cleaning should preferably be reinforced with a reinforcing material. With this, durability of the carrier belt 41 can be improved.

Although an image forming apparatus comprising the toner control member 3 was described in relation to Embodiment 1 to 6 above, present invention is not limited to an image forming apparatus comprising the toner control member 3, and the same effect can be achieved with an image forming apparatus having any configuration provided that an image is formed on an image forming medium by controlling jet of toner towards the recording medium with a toner control member in the image forming apparatus.

Further the cleaning method and apparatus for the same according to the present invention can be applied, in an image forming apparatus in which a toner image formed on an image carrier such as a light-sensitive body is directly transferred to an image forming medium or is transferred via an intermediate transfer body onto an image forming medium, also when toner deposited on a surface of the image carrier or a surface of the intermediate transfer body is to be cleaned.

With the image forming method according to the present invention, by executing cleaning with a combination of an air flow and an electrostatic force, powder on a powder control member can completely be removed and cleaned off even when the cleaning capability and that with an electrostatic force is suppressed to lower levels respectively. With this feature, an air flow generating source with a smaller size as compared to that when cleaning is executed with an air flow can be used, and also generation of electric discharge can be prevented by forming a cleaning electric field by means of applying a lower voltage as compared to a case when it is tried to completely remove powder only with an electric field. In addition, as an electromagnetic force is not used for cleaning the powder control member, even the non-magnetic powder can be cleaned. Furthermore, as cleaning with an air flow and that with an electric field are executed when an image is not being formed, there is provided the effect that an image formed on an image forming medium is not disturbed like in a case where cleaning is executed when an image is formed.

With the image forming apparatus according to the present invention, by executing cleaning with a combination of an air flow and an electrostatic force, powder on a powder control member can completely be removed and cleaned off even when the cleaning capability and that with an electrostatic force is suppressed to lower levels respectively. With this feature, an air flow generating source with a smaller size as compared to that when cleaning is executed with an air flow can be used, and also generation of electric discharge can be prevented by forming a cleaning electric field by means of applying a lower voltage as compared to a case when it is tried to completely remove powder only with an electric field. In addition, as an electromagnetic force is not used for cleaning the powder control member, even the non-magnetic powder can be cleaned.

Particularly, with the image forming apparatus according to the present invention, powder deposited on a surface of the powder control member can be removed and cleaned off with an air flow sucked in or blown out from the air flow port of the counter member for an air flow adjacent to the powder control member, and for this reason there is provided the effect that the powder control member can efficiently be cleaned with an air flow.

Furthermore, particularly with the image forming apparatus according to the present invention, in a case where jet of powder flying from the powder carrier to the counter electrode member is controlled by the powder control member having powder passage holes as well as a control electrode provided around the powder passage holes, and for this reason there is provided the effect that the powder control member can easily be cleaned with a combination of an air flow and an electrostatic force.

Furthermore, particularly with the image forming apparatus according to the present invention, the counter electrode member used for forming a jet electric field for flying powder from the powder carrier is also used as a counter member for an air flow for generating an air flow to the powder control member, so that a size of the apparatus can be made smaller as compared to a case where the counter member for an air flow is provided independently.

Furthermore, particularly with the image forming apparatus according to the present invention, electric potential at a control electrode of the powder control member can be set to a level at which the electric circuit components such as an IC connected to the control electrode are not damaged, and for this reason there is provided the effect that the components are not damaged.

Furthermore, particularly with the image forming apparatus according to the present invention, the powder can be separated from a surface of the powder control member more easily as compared to a case where a cleaning electric field consisting of only a static electric field is used, and for this reason there is provided the effect that the cleaning with a cleaning electric field can efficiently be executed.

Furthermore, particularly with the image forming apparatus according to the present invention, a force for reciprocally moving the powder deposited on the powder control member can surely be effected, and for this reason there is provided the effect that the cleaning with a cleaning electric field can be executed more efficiently.

Furthermore, particularly with the image forming apparatus according to the present invention, powder being moved by a cleaning electric field away from the powder control member can be moved by an air flow in substantially the same direction, and for this reason there is provided the effect that cleanging can be executed more efficiently.

Furthermore, particularly with the image forming apparatus according to the present invention, there is provided the effect that generation of electric discharge by a cleaning electric field can be prevented.

Furthermore, particularly with the image forming apparatus according to the present invention, there is provided the effect that an air flow generating unit such as a low-cost fan generating less noise can be used therein.

Furthermore, particularly with the image forming apparatus according to the present invention, powder is not deposited on a surface of a member such as a counter member for an air flow (counter electrode member) constituting a cleaning electric field generating unit, and for this reason there is provided the effect that a surface of an image forming medium in the side of the counter electrode member on which image is not formed thereon is not contaminated by powder.

Furthermore, particularly with the image forming apparatus according to the present invention, cleaning with an air flow can be executed more efficiently.

Furthermore, particularly with the image forming apparatus according to the present invention, there is provided the effect that size of an air flowing unit such as a fan for generating an air flow in a space adjacent to the powder control member can be minimized and also a voltage for forming a cleaning electric field in the space can be made lower to a safe level.

With the cleaning device according to the present invention, by executing cleaning with a combination of an air flow and an electrostatic force, and powder on a surface to be cleaned can completely be removed even if the cleaning capability with an air flow and that with an electrostatic force can be suppressed to lower levels respectively. For this reason, not only an air flow generating source with a small size as compared to that when cleaning is executed only with an air flow can be used, but also a cleaning electric field can be formed for preventing generation of electric discharge by applying a lower voltage as compared to that required in a case where it is tried to completely remove powder only with an electric field. Furthermore, as electromagnetic force is not used for cleaning, there is provided the effect that the excellent cleaning capability can be realized even to non-magnetic powder.

With the image forming apparatus according to the present invention, even in a case where a cleaning device making it possible to clean the powder control member by means of non-contact cleaning not giving any damage due to friction, each powder control member can be cleaned by successively moving the cleaning device to a cleaning position opposing to each powder control member, and for this reason there is provided the effect that each powder control member can be cleaned in a better way and with a smaller number of components as compared to the configuration in which a plurality of cleaning devices are provided in correspondence to the powder control members.

Particularly, with the image forming apparatus according to the present invention, there is provided the effect that, by successively moving the cleaning device with the driving unit to a cleaning position opposing to each powder control member, each powder control member is cleaned, and the moving path of the belt member becomes identical to the moving path of the cleaning apparatus, and for this reason there is provided the effect that reduction in size of the apparatus becomes possible.

Particularly, with the image forming apparatus according to the present invention, as the cleaning device can be moved by moving the belt member, a driving unit required only for moving the cleaning device is not required, which enables cost reduction for the apparatus. In addition, as an escaping position for the cleaning device can be provided on a moving path of the belt member, there is provided the effect that further size reduction is possible.

Furthermore, particularly with the image forming apparatus according to the present invention, as the cleaning member provided in the turning-around area when a portion of the belt member is turned around can successively be moved to a cleaning position of a powder control member in each image forming section, so that it is not necessary to acquire a space for arrangement of the cleaning member at a place off from a moving path of the belt member, and for this reason there is provided the effect that number of components can be reduced and at the same time a size of the apparatus can be reduced.

Furthermore, particularly with the image forming apparatus according to the present invention, there is provided the effect that number of required components can further be reduced by using one of the rotating members for the belt turning-around unit as the cleaning member.

Furthermore, particularly with the image forming apparatus according to the present invention, the cleaning device does not interfere the counter electrode member; and for this reason there is provided the effect that the cleaning device can be moved to a cleaning position in each image forming section.

Furthermore, particularly with the image forming apparatus according to the present invention, a belt member as a common counter electrode member formed with a conductive material is used to fly the powder on each powder carrier, and for this reason there is provided the effect that a number of required components can be reduced.

Furthermore, particularly with the image forming apparatus according to the present invention, by swinging a belt unit including a belt member, a cleaning device for cleaning each powder control member can be moved to a cleaning position without being contacted to the belt member, and for this reason there is provided the effect that durability of the belt member can be improved.

With the image forming apparatus according to the present invention, an opening for cleaning formed on the belt member is located at a position opposing to the powder control member, and the powder can be cleaned with the counter electrode member also used as the cleaning member via the opening, and for this reason there is provided the effect that each powder control member can easily be cleaned even if a cleaning device dedicated to non-contact cleaning of the powder control member is not provided without giving any damage thereto.

Particularly with the image forming apparatus according to the present invention, there is provided the effect that switching between the state for cleaning the counter electrode member and the image-formation enabled state where interference with the belt member does not occur can easily be executed only by rotating the counter electrode member also sued as the cleaning member.

Furthermore, particularly with the image forming apparatus according to the present invention, there is provided the effect that durability of the belt member can be improved.

Furthermore, particularly with the image forming apparatus according to the present invention, powder on each powder control member can completely be removed and cleaned off even when the cleaning capability with an air flow and that with an electrostatic force are suppressed to lower levels respectively. For this reason there is provided the effect that an air flow generating source with a smaller size as compared to a case where cleaning is executed with an air flow can be moved, and also that generation of electric discharge can be prevented by forming a cleaning electric field by means of applying a lower voltage as compared to a case where it is tried to completely remove powder only with an electric field. Furthermore, as a electromagnetic force is not used for cleaning the powder control member, there is provided the effect that excellent cleaning capability can be realized even to non-magnetic powder.

Although particular embodiment of the present invention have been described in detail, it should be appreciated that numerous variations, modifications, and adaptations maybe made without departing from the scope of the present invention as defined in the claims.

Industrial Applicability

The present invention is applicable to copier, facsimile device and printer or the like.

What is claimed is:

1. An image forming method for forming an image on an image forming medium by making an electrically charged powder as an image forming substance jet via a powder control member having holes thereon through which said powder can pass towards the recording medium and selectively allowing passage of the powder flying towards said recording medium through the holes according to image information;

wherein an air flow is generated in a space adjacent to said powder control member and a cleaning electric field for removing said powder adhered to said powder control member is formed in said space.

2. An image forming apparatus for forming an image on an image forming medium by making an electrically charged powder as an image forming substance jet via a powder control member having holes thereon through which said powder can pass towards the recording medium and selectively allowing passage of the powder flying towards said recording medium through the holes according to image information; said image forming apparatus comprising:

an air flow generating unit for generating an air flow in a space adjacent to said powder control member;

a cleaning electric field forming unit for forming a cleaning electric field making said powder move away from said powder control member in said space; and a control unit for controlling the generation of an air flow by said air flow generating unit as well as the formation of a cleaning electric field by said cleaning electric field forming unit.

3. An image forming apparatus according to claim 2; wherein said air flow generating unit comprising:

a counter member for an air flow having an air flow port for sucking or blowing out an air flow to and from said powder control member; and a driving unit for driving said counter member for an air flow so that said air flow port can be positioned at an opposite position close to and facing said powder control member and at an off position away from said powder control member.

4. An image forming apparatus according to claim 3 comprising a powder carrier for carrying thereon an electrically charged powder as an image forming substance; a counter electrode member arranged at a position opposing to said powder carrier; a jet electric field forming unit for forming a jet electric field making said powder on said powder carrier jet towards said counter electrode member; a powder control member having powder passage holes for controlling jet of the powder from said powder carrier to said counter electrode member between said powder carrier and said outer electrode member and also having a control electrode in a space around each of said powder passage holes; and a power source for applying a voltage to said control electrode according to image information;

wherein said cleaning electric field forming unit comprises a cleaning electrode provided around the air flow port of said counter member and a power source for cleaning for applying a voltage for forming said cleaning electric field between said cleaning electrode and said control electrode.

5. An image forming apparatus according to claim 4; wherein said counter electrode member comprises a rotatable cylindrical member with said air flow port formed thereon or a belt member and is also used as said counter member for air flow.

6. An image forming apparatus according to claim 4; wherein said cleaning electric field is mainly formed by a applying a voltage to said cleaning electrode.

7. An image forming apparatus according to claim 3; wherein a gap between said counter member for air flow when said air flow port is present at said opposite position and said powder control member is set to a value smaller than that when said air flow port is present at said off position.

8. An image forming apparatus according to claim 3; wherein a gap between said counter member for air flow when said air flow port is at said opposite position and said powder control member is set to a value less than 0.3 mm.

9. An image forming apparatus according to claim 2; wherein said cleaning electric field is an electric field formed by superimposing an alternating electric field to a static electric field.

10. An image forming apparatus according to claim 9; wherein a frequency of said alternating electric field is set to a range higher than 0.5 kHz or lower than 3 kHz.

11. An image forming apparatus according to claim 2; wherein orientation of said air flow and that of said cleaning electric field are set so that orientation of movement of powder moved by said air flow and that of powder moved by said cleaning electric field are identical.

12. An image forming apparatus according to claim 2; wherein maximum value of said cleaning electric field is set to a value smaller than a discharge start electric field obtained according to a Paschen's electric discharge curve.

13. An image forming apparatus according to claim 2; wherein an air pressure difference between an air pressure within said counter member for air flow for sucking or blowing out an air flow to and from said powder control member and the atmospheric pressure is set to a value less than 15 mm ($H_2O$).

14. An image forming apparatus according to claim 2; wherein formation of said cleaning electric field by said cleaning electric field forming unit is started in the state where an air flow has been generated by said air flow generating unit.

15. A cleaning device for removing electrically charged powders adhered to a body, comprising:

an air flow generating unit for generating an air flow in a space adjacent to said body; and a cleaning electric field forming unit for forming a cleaning electric field for removing the powders from said body in said space.

16. An image forming apparatus comprising a plurality units of image forming section each forming an image on an image forming medium by making an electrically charged powder as an image forming substance jet via a powder control member having powder passage holes towards the recording medium and selectively allowing passage of said powder flying towards said recording medium through said powder passage hole according to image information, and also having a belt member which can move along image forming positions on the image forming section and a belt driving unit, for driving said belt member;

wherein a cleaning device for cleaning said powder control member is movably provided between a cleaning position opposing to said powder control member and an escaping position off from said image forming position.

17. An image forming apparatus according to claim 16; wherein said cleaning device can move along said belt member and also there is provided a driving unit for moving said cleaning device between said escaping position and said cleaning position.

18. An image forming apparatus according to claim 17; wherein said cleaning apparatus can be set in the slave state where said cleaning device follows movement of said belt member as well as in the released state where the slave state has been released and there is provided a slave state switching unit for s witching said cleaning device between said slave state and said released state.

19. An image forming apparatus according to claim 18; wherein said cleaning device comprises a belt turning unit for spanning said belt member over a plurality of rotary bodies and turning a portion of said belt member in a direction reverse to the direction in which said belt member opposes to said powder control member, and a cleaning member arranged in an area around which said belt member turns.

20. An image forming apparatus according to claim 19; wherein one of the rotary bodies for said belt turning unit is also used as said cleaning member.

21. An image forming apparatus according to claim 16 with each of the image forming sections comprising a powder carrier for carrying thereon an electrically charged powder as an image forming substance, a counter electrode member arranged at, a position opposing to said powder carrier, a jet electric field forming unit for forming a jet electric field for making the powder on said powder carrier jet towards said counter electrode member, a powder control member having powder passage holes for controlling jet of the powder from said powder carrier to said counter electrode member between said powder carrier and said counter electrode member and also having a control electrode in a space around each of said powder passage hole, said image forming apparatus also having a power source for applying a voltage to said control electrode according to image information;

wherein there is an escaping unit for moving said counter electrode member to an escaping position off from a moving path of said cleaning device.

22. An image forming apparatus according to claim 16 with each of the image forming sections comprising a powder carrier for carrying thereon an electrically charged powder as an image forming substance, a counter electrode member arranged at a position opposing to said powder carrier, a jet electric field forming unit for forming a jet electric field for making the powder on said powder carrier jet towards said counter electrode member, a powder control member having powder passage holes for controlling jet of the powder from said powder carrier to said counter electrode member between said powder carrier and said counter electrode member and also having a control electrode in a space around each of said powder passage hole, said image forming apparatus also having a power source for applying a voltage to said control electrode according to image information;

wherein said belt unit is formed with a conductive material and is used as a common counter electrode member opposing to each powder carrier.

23. An image forming apparatus according to claim 16; wherein a belt unit formed so that said belt member is included therein is provided so that the belt unit can swing around a swinging shaft provided in the side contrary to said escaping position with a cleaning position for said each powder control member therebetween.

24. An image forming apparatus according to claim 23 with each of the image forming sections comprising a powder carrier for carrying thereon an electrically charged powder as an image forming substance, a counter electrode member arranged at a position opposing to said powder carrier, a jet electric field forming unit for forming a jet electric field for making the powder on said powder carrier jet towards said counter electrode member, a powder control member having powder passage holes for controlling jet of the powder from said powder carrier to said counter electrode member between said powder carrier and said counter electrode member and also having a control electrode in a space around each of said powder passage holes, said image forming apparatus also having a power source for applying a voltage to said control electrode according to image information;

wherein said counter electrode member is provided so that it can swing together with said belt unit.

25. An image forming apparatus according to claim 16 using a device for generating an air flow in a space adjacent to said powder control member and also forming a cleaning electric field for moving said powder off from said powder control member when located at a position opposing to said powder control member.

26. An image forming apparatus comprising a plurality units of image forming sections each comprising a powder carrier for carrying thereon an electrically charged powder as an image forming substance, a counter electrode member arranged at a position opposing to said powder carrier, a jet electric field forming unit for forming a jet electric field for making the powder on said powder carrier jet towards said counter electrode member, a powder control member having powder passage holes for controlling jet of the powder from said powder carrier to said counter electrode member between said powder carrier and said counter electrode member and also having a control electrode in a space around each of said powder passage holes, said image forming apparatus also having a belt member which can move along the image forming positions in each image forming section, a belt driving unit for driving said belt member; and a power source for applying a voltage to said control electrode according to image information;

wherein an opening for cleaning is formed in said belt member, and said counter electrode member is also used as a cleaning member for cleaning said powder control member via said opening.

27. An image forming apparatus according to claim 26 using a rotary member with a distance from a portion of its periphery used for said cleaning to a center of rotation longer than a distance from the periphery of the other portion to the center of rotation is used as the counter electrode member also used for said cleaning member, and comprising a rotating/driving unit for driving said rotary member.

28. An image forming apparatus according to claim 26; wherein an edge section of said belt member is reinforced with a reinforcing material.

29. An image forming apparatus according to claim 26; wherein a peripheral edge section of said opening of said belt member is reinforced with a reinforcing material.

* * * * *